US008657064B2

(12) United States Patent
Staab et al.

(10) Patent No.: US 8,657,064 B2
(45) Date of Patent: Feb. 25, 2014

(54) EARPIECE SEALING SYSTEM

(75) Inventors: Wayne Staab, Dammeron Valley, UT (US); John P. Keady, Boca Raton, FL (US)

(73) Assignee: Personics Holdings, Inc., Boca Raton, FL (US)

( * ) Notice: Subject to any disclaimer, the term of this patent is extended or adjusted under 35 U.S.C. 154(b) by 981 days.

(21) Appl. No.: 12/140,937

(22) Filed: Jun. 17, 2008

(65) Prior Publication Data

US 2009/0214072 A1 Aug. 27, 2009

Related U.S. Application Data

(60) Provisional application No. 60/944,524, filed on Jun. 17, 2007.

(51) Int. Cl.
*H04R 25/02* (2006.01)

(52) U.S. Cl.
USPC ..... 181/130; 181/135; 381/328

(58) Field of Classification Search
USPC ..... 181/129, 130, 135; 381/322, 328
See application file for complete search history.

(56) References Cited

U.S. PATENT DOCUMENTS

| | | | | |
|---|---|---|---|---|
| 2,535,258 | A | 12/1950 | Bland | |
| 3,602,654 | A | 8/1971 | Victoreen | |
| 4,741,344 | A | 5/1988 | Danby et al. | |
| 4,834,211 | A | 5/1989 | Bibby et al. | |
| 4,896,679 | A | 1/1990 | St. Pierre | |
| 4,962,537 | A | 10/1990 | Basel et al. | |
| 5,333,622 | A | 8/1994 | Casali et al. | |
| 5,483,027 | A | 1/1996 | Krause | |
| 6,094,494 | A | 7/2000 | Haroldson | |
| 6,256,396 | B1 | 7/2001 | Cushman | |
| 6,339,648 | B1 | 1/2002 | McIntosh et al. | |
| 6,393,130 | B1 | 5/2002 | Stonikas et al. | |
| 6,671,381 | B1 | 12/2003 | Lux-Wellenhof | |
| 7,130,437 | B2 | 10/2006 | Stonikas et al. | |
| 7,164,775 | B2 | 1/2007 | Meyer et al. | |
| 7,227,968 | B2 | 6/2007 | van Halteren et al. | |
| 7,362,875 | B2 | 4/2008 | Saxton et al. | |
| 7,387,187 | B2 | 6/2008 | Widmer et al. | |
| 2002/0196958 | A1* | 12/2002 | Halteren et al. | 381/328 |
| 2005/0117765 | A1* | 6/2005 | Meyer et al. | 381/322 |
| 2006/0159298 | A1 | 7/2006 | von Dombrowski et al. | |
| 2007/0116319 | A1 | 5/2007 | Hagberg | |
| 2008/0144871 | A1 | 6/2008 | Purcell et al. | |
| 2009/0173353 | A1 | 7/2009 | Purcell et al. | |
| 2009/0320858 | A1 | 12/2009 | Purcell et al. | |
| 2009/0320859 | A1 | 12/2009 | Purcell et al. | |

* cited by examiner

*Primary Examiner* — Jeremy Luks

(57) ABSTRACT

Earphone devices with a sealing section for acoustically sealing the meatus of a human ear are provided. An earphone device includes an inner ear canal speaker and an inner ear canal microphone, each connected to a logic circuit which can include a digital signal processor (DSP). A sealant element is operatively attached to an outer section of the earphone and acoustically seals the meatus of a human ear canal.

21 Claims, 30 Drawing Sheets

ITE - In-the-Ear

ITC - In-the-Canal

CIC - Completely-in-the-Canal

PT - Peritympanic

2500

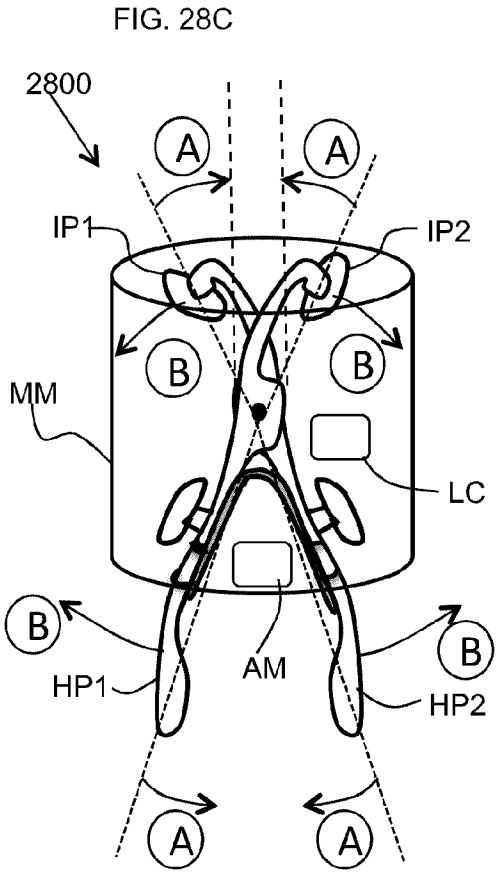
FIG. 28C
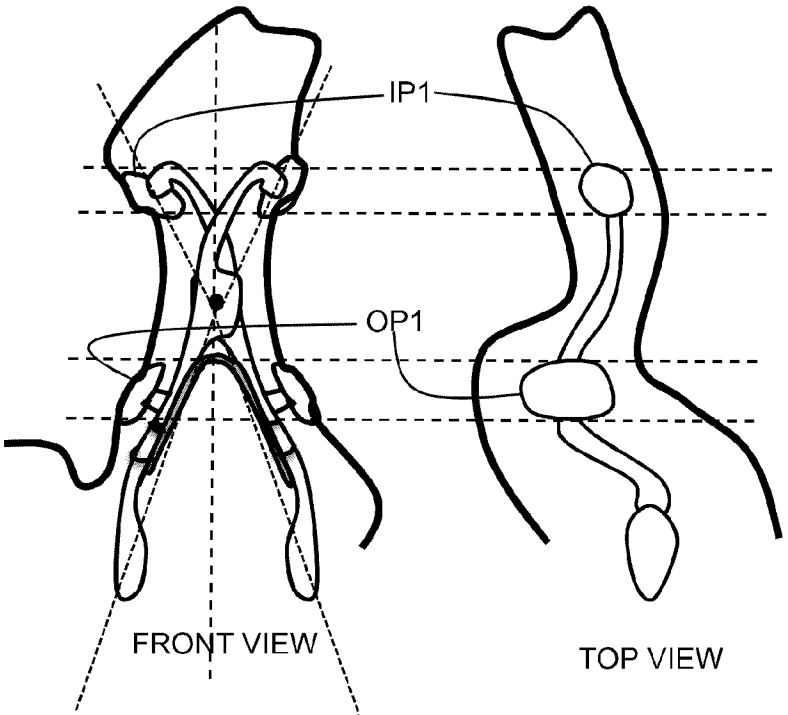
FIG. 28A
FIG. 28B

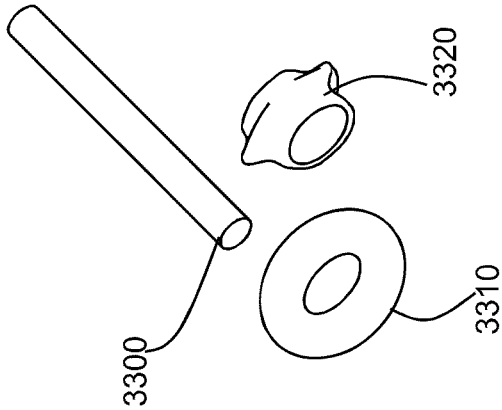
FIG. 29C
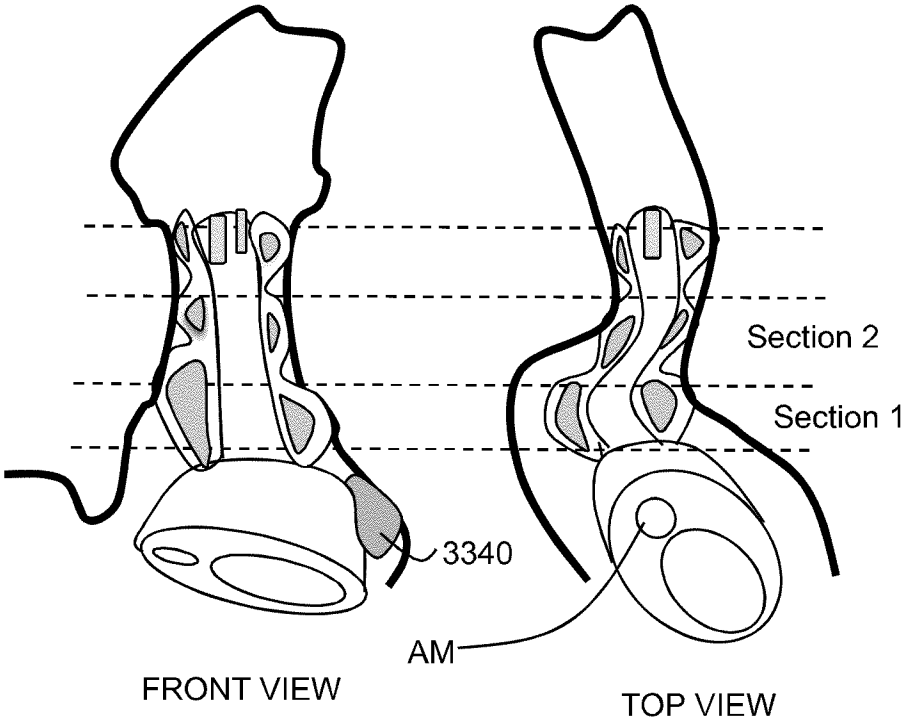
FIG. 29A
FIG. 29B
FRONT VIEW
TOP VIEW

EARPIECE SEALING SYSTEM

CROSS-REFERENCE TO RELATED APPLICATIONS

This application claims the benefit of U.S. provisional patent application No. 60/944,524 filed on 17 Jun. 2007. The disclosure of which is incorporated herein by reference in its entirety.

FIELD OF THE INVENTION

The invention relates in general to devices and methods of earphone, earpiece, earbud, fit and sealing technology, and particularly though not exclusively, is related to eargear earpiece systems.

BACKGROUND OF THE INVENTION

Present day ear devices are intended to deliver information to the ear via off-the-shelf or custom-molded pieces that present the information primarily in the outer third of the ear canal, often with questionable attention to the actual fit, comfort, and consideration of the ear anatomy and physiology. This earpiece is designed to use this information in an embodiment that sections the auricle and ear canal in a sandwich-type arrangement from the auricle into the ear canal with varying sections devoted to managing these issues.

FIGS. 1-6 illustrate general physiology of the ear that will be referred to herein when describing exemplary embodiments. For example FIG. 1 illustrates the general physical arrangement of the ear region, including a pinna (auricle) 100, ear canal 110, the eardrum 120, middle ear chamber 130, ossicles 140, eustachian tube 160, semicircular canals 170 and auditory nerve 180.

FIG. 2 illustrates the pinna, including the helix 200, crus of the helix 220, external auditory canal (meatus) 230, tragus 240, intertragal notch 250, antitragus 265, concha 280, and antihelix 260.

FIG. 3 illustrates a general illustration of the ear canal, including the cartilaginous portion 300, bony portion 310, and the first turn 320 of the ear canal 230, and the second turn 330 of the ear canal 230.

FIG. 4 shows the underlying structure surrounding the ear canal, including the substantial substructure of the cartilaginous portion 400 that allows for some expansion by an inserted object, and the bony portion 410 substructure, showing that essentially no expansion of this area occurs when an object is inserted to this depth.

FIG. 5 illustrates the angle of the ear canal relative to the head, at about 45°, upward in direction.

FIG. 6 illustrates the general shape of the ear canal, showing concha bowl 630, the directions and location of the first turn 600, second turn 610, and isthmus 620 (narrowest part of the ear canal, between the first and second bends).

SUMMARY OF THE INVENTION

At least one exemplary embodiment is related to an earpiece (e.g., earphone, earbud, or other devices configured to direct acoustic signals to the ear) inserted into the ear canal, where a portion of a sealant section acoustically seals a medial portion of the external auditory canal 110 (ear canal).

At least one exemplary embodiment is directed to an earpiece of varying density and expansion, and designed to contain various electronics, and to allow for ease of insertion, removal, comfort, and acoustic performance. When used as a sound delivery device, the ear canal is sealed in the medial portion of the meatus by an ear plug, so that the ear canal is relatively free of external noise. Additionally, the sound field in the cavity generated by the person's own voice contains all the frequency components necessary to reconstruct the speech with good intelligibility as picked up by a medial canal microphone. The earpiece can seal the ear canal by using a sealant element attached to an outer portion of the earpiece that conforms as the earpiece is pressed into the ear canal.

Further areas of applicability of embodiments of the present invention will become apparent from the detailed description provided hereinafter. It should be understood that the detailed description and specific examples, while indicating exemplary embodiments of the invention, are intended for purposes of illustration only and are not intended to limit the scope of the invention.

BRIEF DESCRIPTION OF THE DRAWINGS

Exemplary embodiments of the present invention will become apparent from the following detailed description taken in conjunction with the following drawings.

FIGS. 28A, 28B and 28C illustrate an earclip support configuration encased in a moldable material, which can also be sectional of various materials, where the earclip expands the moldable material securing an earpiece in the ear canal.

FIGS. 29A, 29B and 29C illustrate an earpiece (e.g., hearing aid) where various shaped rings of various moldable material, designed for various sections of the ear canal, can surround a hard core irregular tube which can support electronic packages (e.g., ambient microphone, inner microphone, inner speaker, logic circuit, power source).

DETAILED DESCRIPTION OF EXEMPLARY EMBODIMENTS OF THE PRESENT INVENTION

The following description of exemplary embodiment(s) is merely illustrative in nature and is in no way intended to limit the invention, its application, or uses.

Processes, methods, materials and devices known by one of ordinary skill in the relevant arts may not be discussed in detail but are intended to be part of the enabling discussion where appropriate. For example the fillable material can be either a gas, liquid or gel.

Additionally, the size of structures used in exemplary embodiments are not limited by any discussion herein (e.g., the sizes of structures can be macro (centimeter, meter, size), micro (micro meter), nanometer size and smaller).

Figure 1:
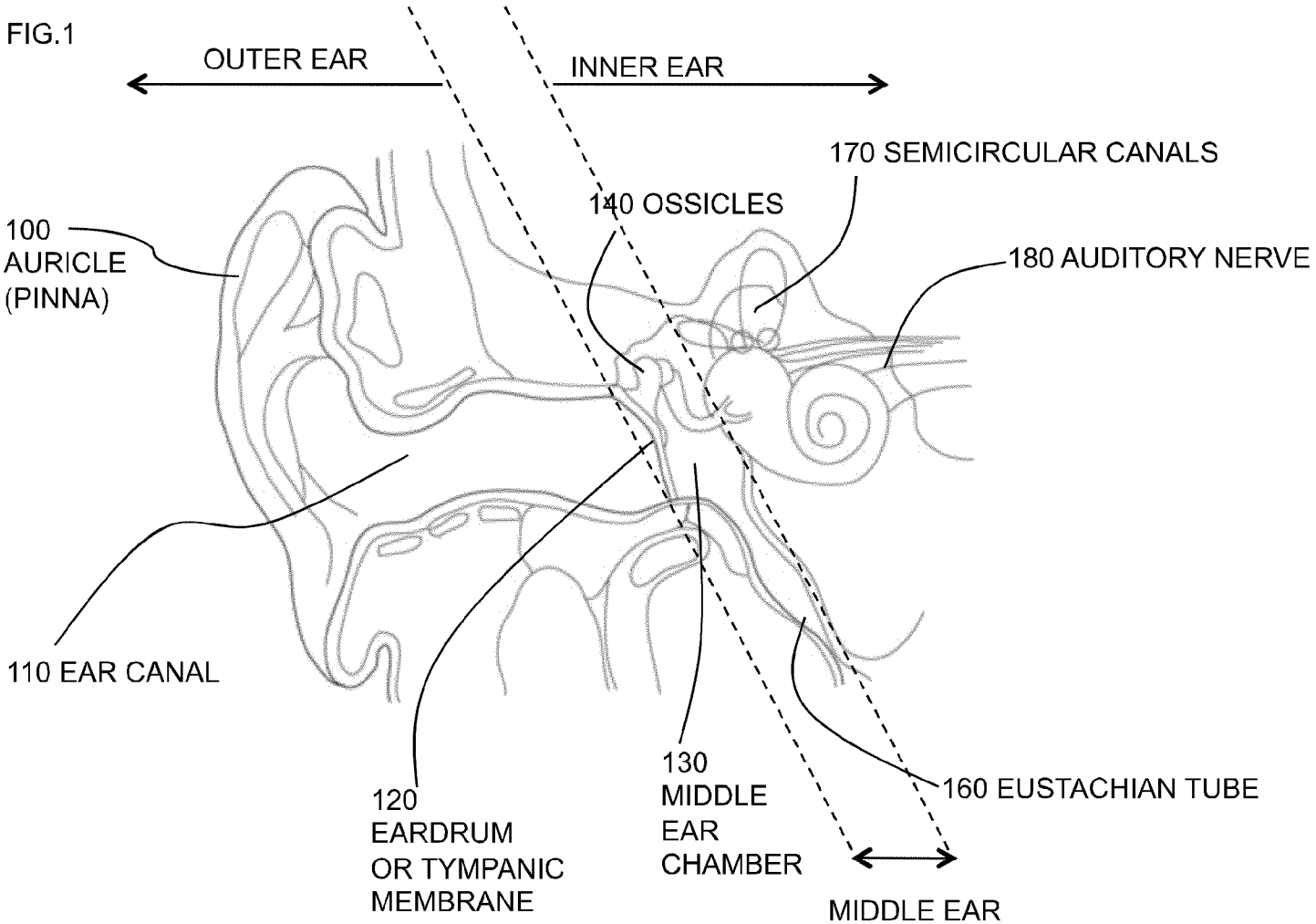
FIGS. 1-6 illustrate general ear physiology laying the foundation of terms used herein.
Figure 2:
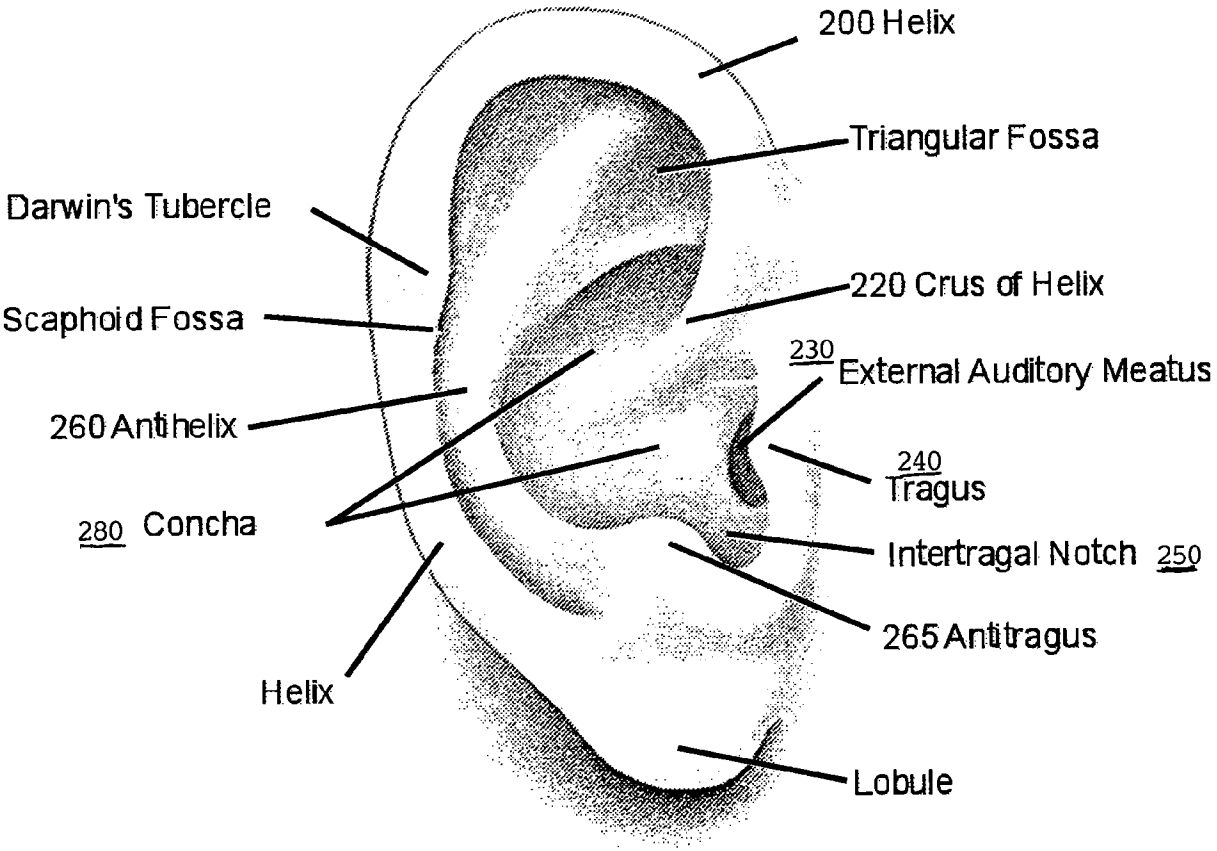
Figure 3:
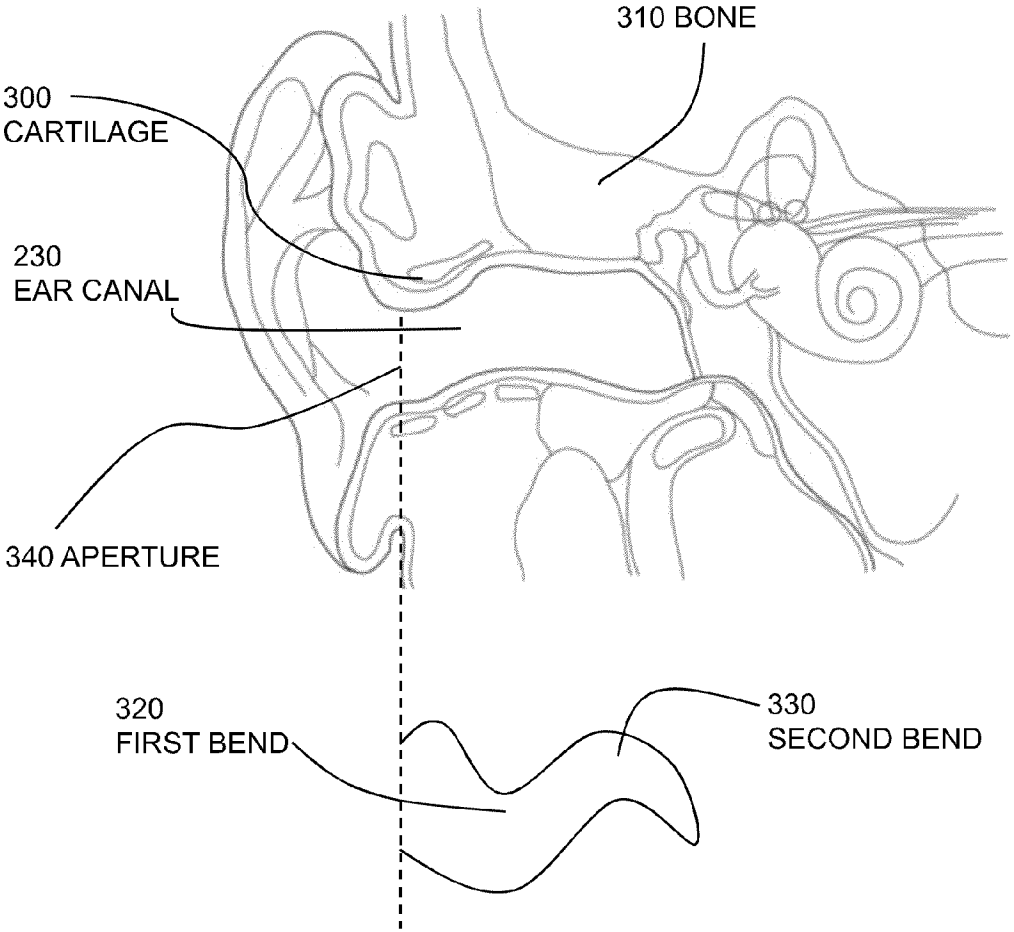
Figure 4:
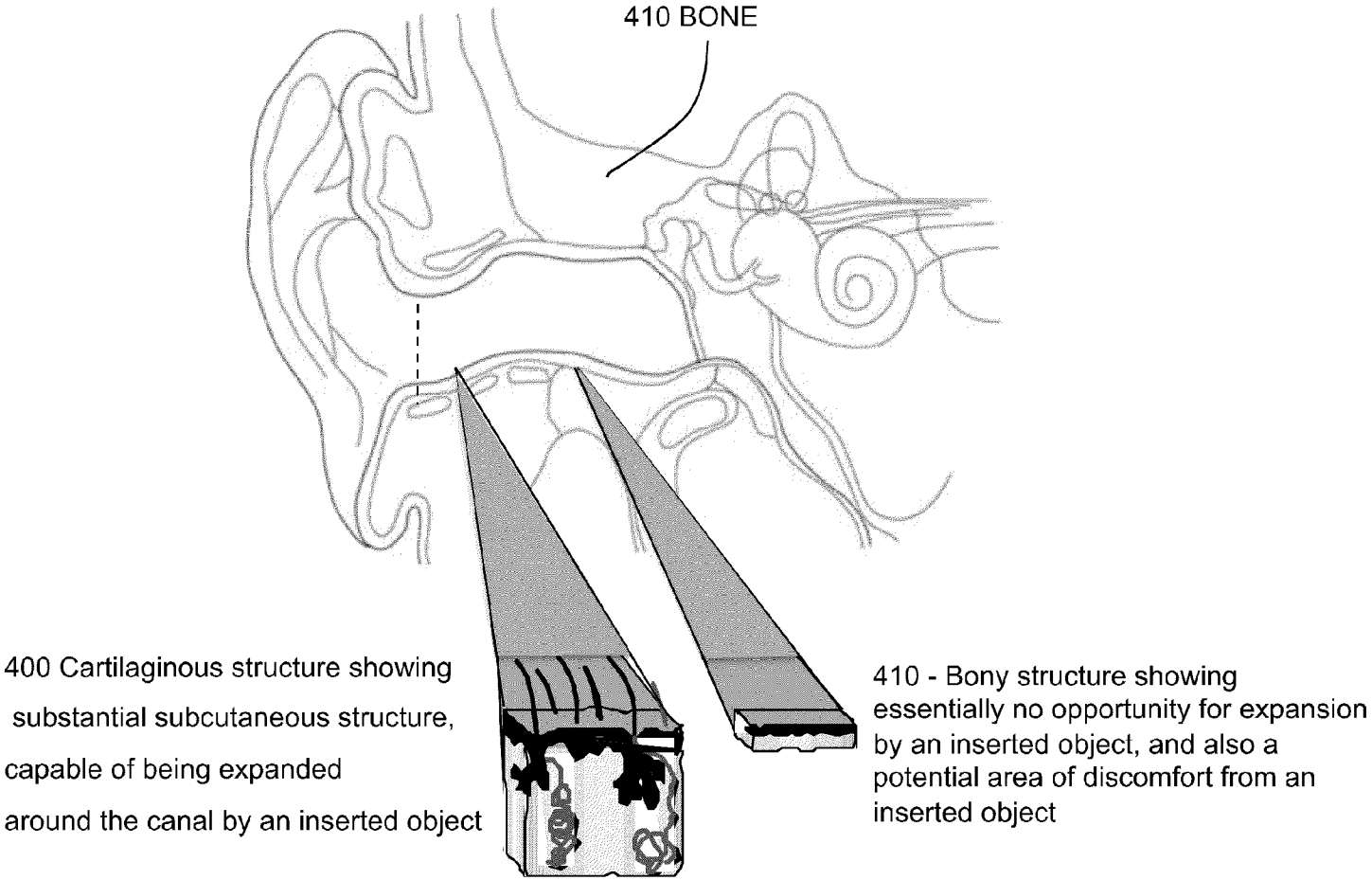
Figure 5:
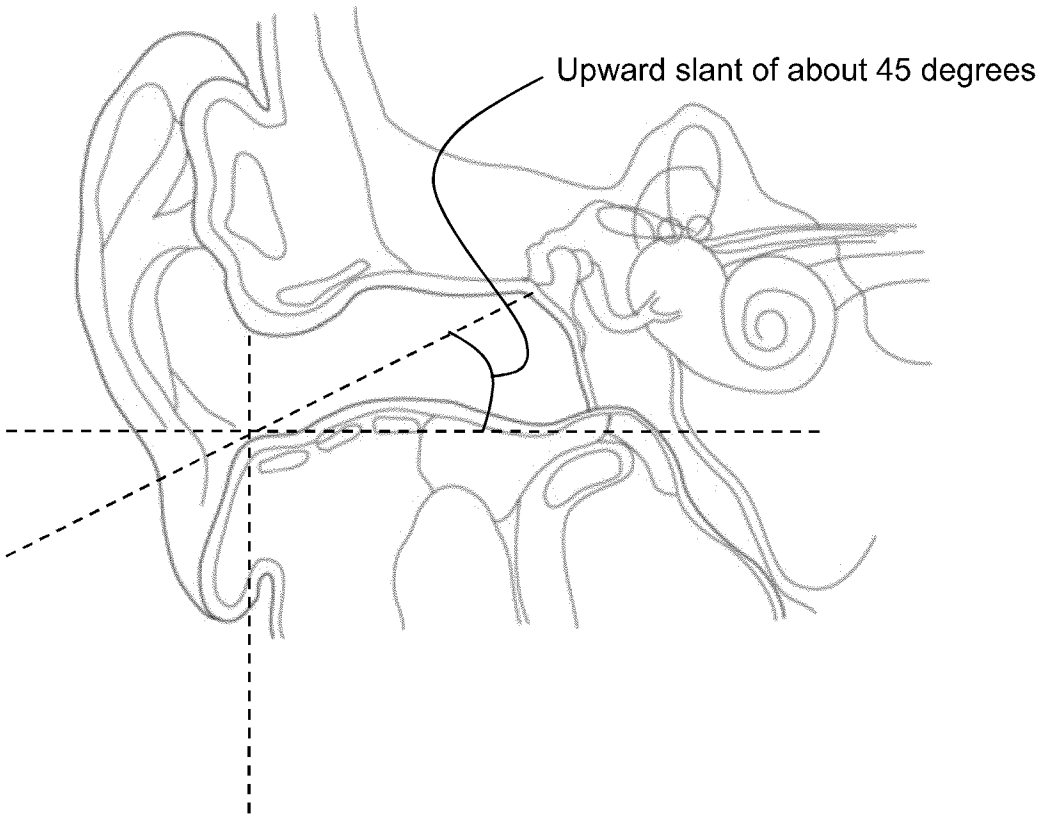
Figure 6:
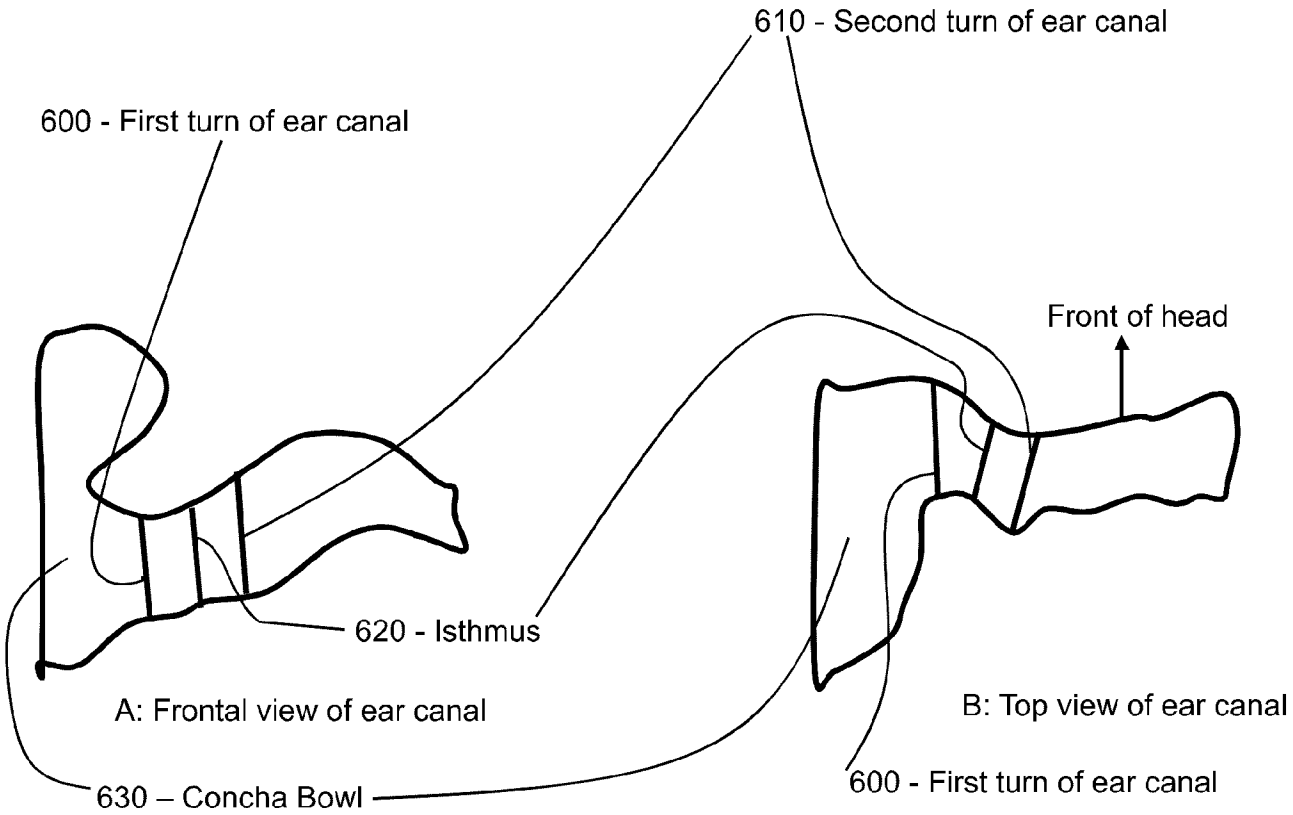
Figure 7:
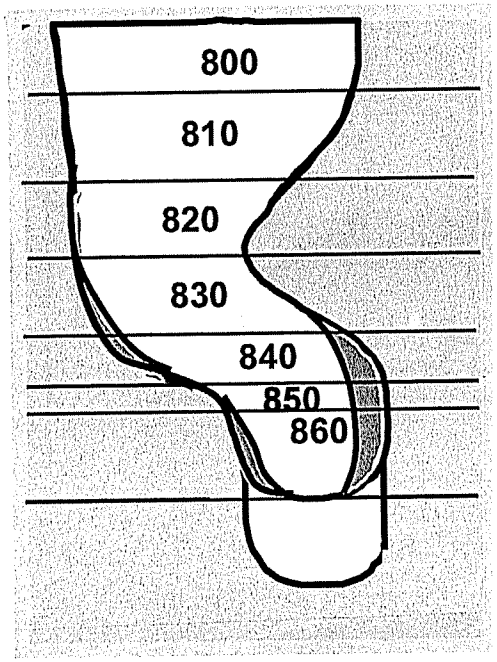
FIG. 7 illustrates the general layer configuration of various section properties along the ear canal that form the basis of the sandwich approach of at least one exemplary embodiment.
Figure 8:
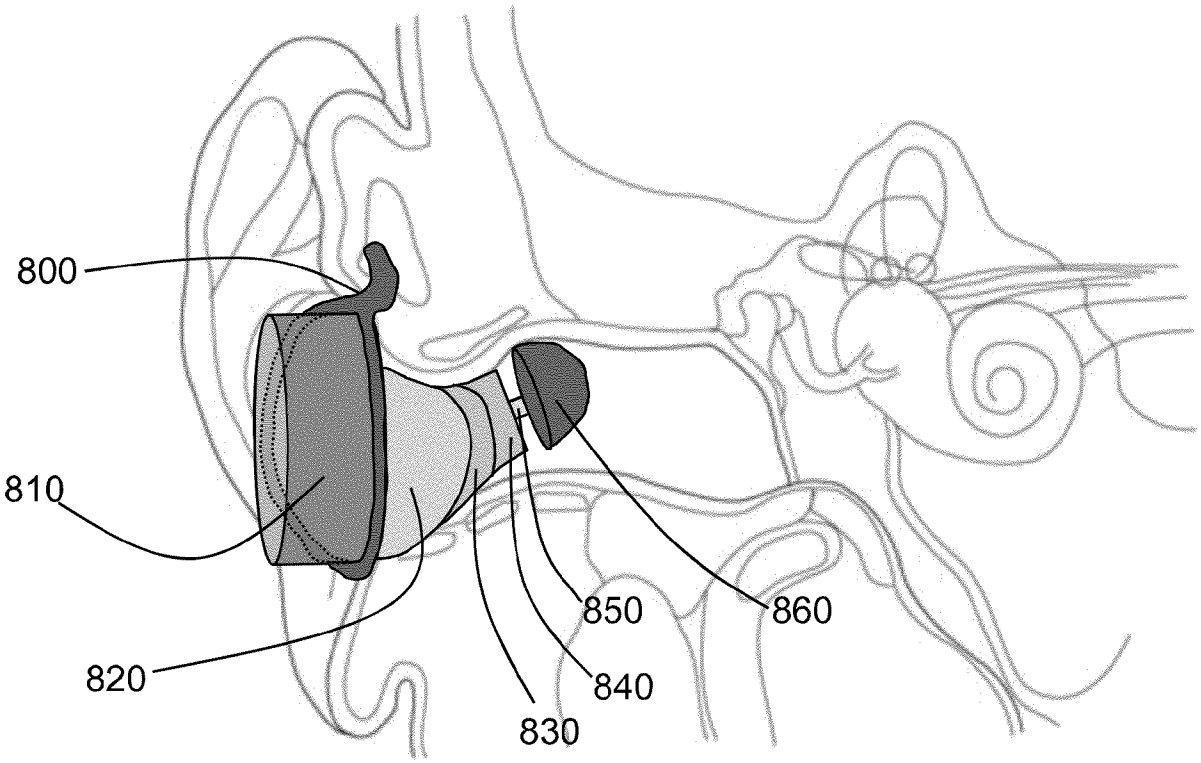
FIG. 8 illustrates at least one exemplary embodiment using a layered approach (i.e., a sandwich approach), where various layers have different materials based upon ear physiology and its effect on comfort (pressure sensitivity).

In one embodiment the earpiece is sectioned in layers to represent different earpiece performances, fit, insertion, and comfort. FIG. 7 illustrates this design. Each section has different embodiments associated with it.

Figure 9:
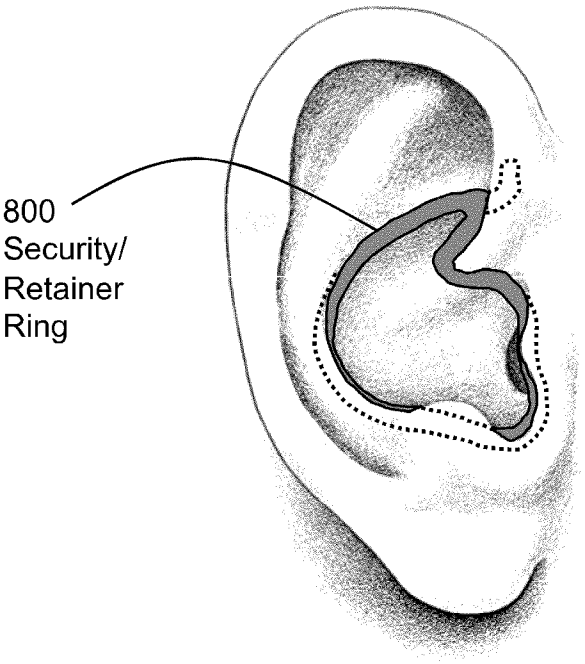
FIG. 9 illustrates at least one method of securing an earpiece to a particular ear in accordance with at least one exemplary embodiment.

Retainer/Security Ring 800 fits the concha bowl and which is held in position by the helix 200, antihelix 260, crus of helix 220, and antitragus 265 (FIG. 9). This can be a simple ring of acrylic, rubber, silicone, or other material, either moldable or of various fixed sizes, and to which the electronics package 810 attaches by friction, threads, turning action, screws or other attachment means, whether replaceable or permanent. For example the various parts can be:

800—Security/retainer ring to fit the concha. Hard or soft construction.

810—Primary area for electronics. This part of the canal can expand somewhat (for example 25%). Hard or soft construction. Combined with 800.

820—Secondary area for electronics. This can narrow down to the bone, so an area most medial must have some softness and must be pliable to accommodate ear canal movement.

830—Primary area to accommodate mandibular movement. Can be very soft, pliable, and flexible. Can serve only as a narrow channel for electronic connections.

840—Primary retention area. Can be soft and pliable, and expandable to fill the area.

850—Conduit area to accommodate probe(s) to, and/or for microphone (also referred to herein as a mic) and speaker.

860—Primary seal area, but can also be sensitive to pressure. Can also have this section softly expandable.

Primary electronics package 810 contains the major electronics for the earpiece. It can be separate, or contiguous with the secondary electronics area 820. The configuration can be round, square, oval, or any other shape or size that allows it to fit the general concha 280 area. It can extend laterally as a separate package or in multiple layers, each layer providing an additional performance function.

Canal entrance/secondary electronics package 820 is shaped to fit the opening of the ear canal (aperture 340). It fits snugly, aided by the use of soft, pliable surface material or coating, but with an internal hard cavity. It can be separate or in conjunction with the primary electronics package 810. The hard cavity tapers sharply medially to allow for ease of insertion and comfort. This can have a tapered surface coating having various densities, the thinnest being laterally toward 810, and thickest medially toward 830.

Electronics packages can attach to security/retainer ring 800 and can be added to laterally, for additional functions of the device. It can be of any size or shape to fit within the concha bowl area 280.

Soft, flexible/expandable section 830 can manage mandibular movement. A soft expandable medium can be used to maintain contact with the ear canal wall when the jaw moves (mandibular movement). For example a heat expansive material, light expandable, or other materials that would maintain a comfortable level of pressure, for example one that can expand about 1 mm beyond and not stretch ear canal wall.

The fillable material referred to herein can be viscous and can include silicone-based polymers, gels, vinyl elastomers, or any other material of sufficient properties to allow the deformation of a membrane cavity from user contact. Materials can also be used to provide a slow reformation of the original membrane cavity shape after it has been deformed and released. In this regard, a silicone gel or other non-cross-linked polymer or uncatalyzed materials may be used. It should be appreciated that the composition of the fillable material could be altered for applications in which varied membrane characteristics are desired (i.e. more stiffness, durability, more or less deformability and/or longer-lasting deformation). The fillable material may be elastically deformed or it may be deformed by displacement, which is the actual movement or flow of the fillable material in response to pressure, such as that from a user's fingertips. In addition, the fillable material could be altered for applications in which varied temperature or light conditions would be encountered during the use of particular products on which the membrane cavity is mounted.

The portion of a membrane connected to a structure (base membrane) can be made of any material, rigid or elastic, including various plastic or metal materials, or it can be made of a membrane formed of thin rubber-based material, deformable plastic or silicone-based materials or other elastomeric materials suitable for a given application. If the base is configured as a flexible membrane, the cavity can more easily conform to a product's surface, thereby increasing the ease with which the cavity can be installed, removed, and replaced. Likewise, the outer membrane also can be made of a thin rubber-based material, deformable plastic or silicone polymer materials, or other elastomeric materials suitable for a given application. If the base membrane and outer membrane are made of silicone material, both should be from 0.50 mm to 2.5 mm in thickness. In this regard, the base may be a membrane instead of a piece of rigid material. The edges of the outer membrane and the base membrane can be mechanically fastened or clamped forming the membrane cavity. Additionally, at least a portion of the base membrane can be adhesively attached (e.g., adhesive tape, glue) or mechanically fastened to the support structure.

The silicone sealant can be of an acetoxy cure type. In particular, upon exposure to moisture, the silicone sealant will give off small amounts of acetic acid while the sealant cures. It is not recommended that the acetic acid vapors be inhaled. The sealant will cure in 24 hours and has a tack free time of 10-20 minutes at 77.degree. F. (25.degree. C.) with 50% relative humidity. The sealant's tensile strength is approximately 350 psi, its elongation property is 450%, and its hardness is approximately 25-30 Shore A. The sealant has temperature stability from −85.degree. F. to 450.degree. F. (−65.degree. C. to 232.degree. C.) and can withstand intermittent exposure to temperatures as high as 500.degree. F. (280.degree. C.). The sealant is believed to have good resistance to various weathering conditions, including UV radiation, rain, snow, etc, without hardening, cracking, or shrinking.

For optimum adhesion with the above adhesive, the support structure and the lower surface of the base membrane should be clean, dry, and free from oil, grease or other foreign material. If necessary, metal surfaces should be wiped with a non-oily solvent. Rubber surfaces should be abraded to promote adhesion. Depending on environmental conditions, the base and product surface should be joined within 5-10 minutes, before the tack-free time of the sealant passes.

FIG. 9 illustrates at least one method of securing an earpiece to a particular ear in accordance with at least one exemplary embodiment. For example a security/retainer ring is designed to hold the electronics package in the concha bowl 280 of the ear. The security/retainer ring can be made of different sizes to fit a wide range of ears, with fixed-sized electronics package fitting inside, and attached firmly, but removable from the ring. This allows for changes to different size ear conchas without changing the electronic package. The ring can be made of acrylic, hard rubber, or any other material, including that which is flexible, but with the ability to mold to the user's ear.

Figure 10:
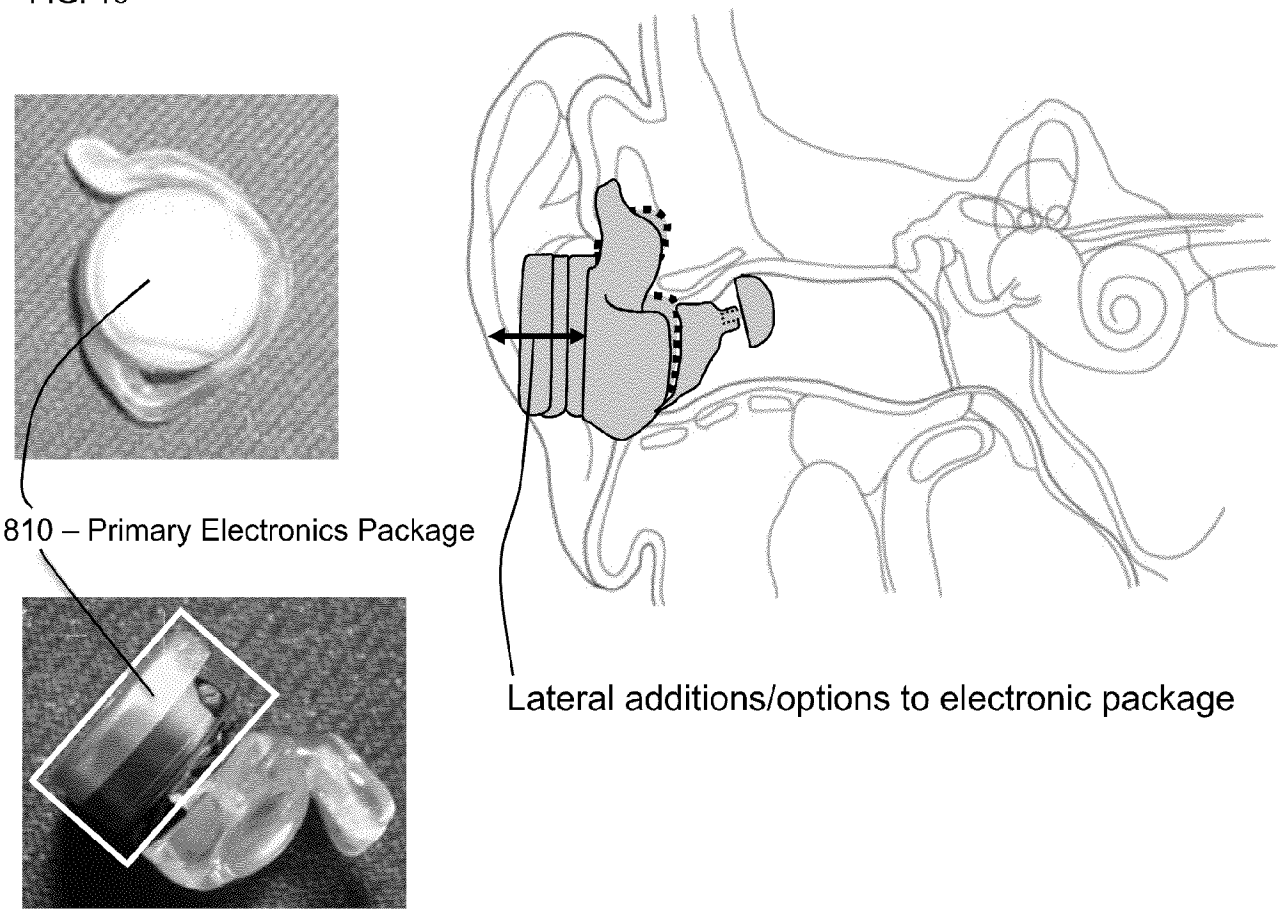
FIG. 10 illustrates at least one exemplary embodiment where the electronics package can be stacked (added when more functionality is desired).

FIG. 10 illustrates at least one exemplary embodiment where the electronics package can be stacked (added when more functionality is desired). For example the electronics package can be limited in size medially, depending on the ear opening size, but is essentially without limit, laterally.

Figure 10A:
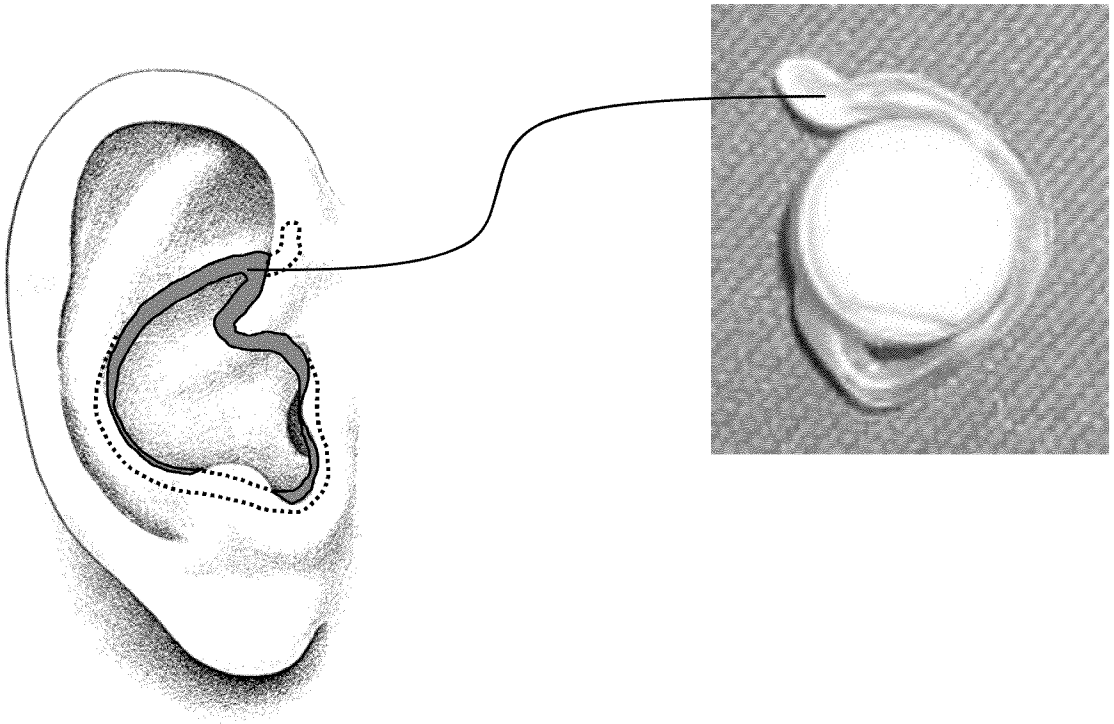
FIG. 10A illustrates a security retainer and its relation to the primary area electronics.

FIG. 10A illustrates a security retainer and its relation to the primary area electronics. For example a security/retainer ring 800 can be designed to hold the electronics package in the concha bowl of the ear. The security/retainer ring 800 can be made of different sizes to fit a wide range of ears, with fixed-sized electronics package fitting inside, and attached firmly, but removable from the ring 800. This allows for changes to different size ear conchas without changing the electronic package. The ring 800 can be made of acrylic, hard rubber, or any other material, including that which is flexible, but with the ability to mold to the user's ear.

An electronics package attached to security/retainer ring 800 can be added laterally, for additional functions of the device.

Figure 11:
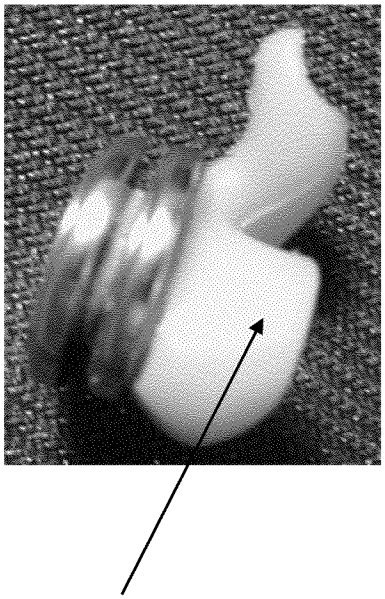
FIG. 11 illustrates a region of additional (secondary) electronic package space in accordance with an earpiece device of at least one exemplary embodiment.

FIG. 11 illustrates a region of additional (secondary) electronic package space in accordance with an earpiece device of at least one exemplary embodiment. For example section 820 allows for limited physical expansion once placed in the ear because it is in the cartilaginous area 300 of the ear canal 230, which can often accommodate objects slightly larger than the canal aperture 340. Section 820 can narrow down to the bony substructure 310, and the area most medial has a pliable material to accommodate ear canal movement that occurs with speaking and chewing. A soft-type coating helps hold the device in position and assists in overcoming this movement. Section 820 can also provide a secondary area for earpiece electronics.

Figure 12:
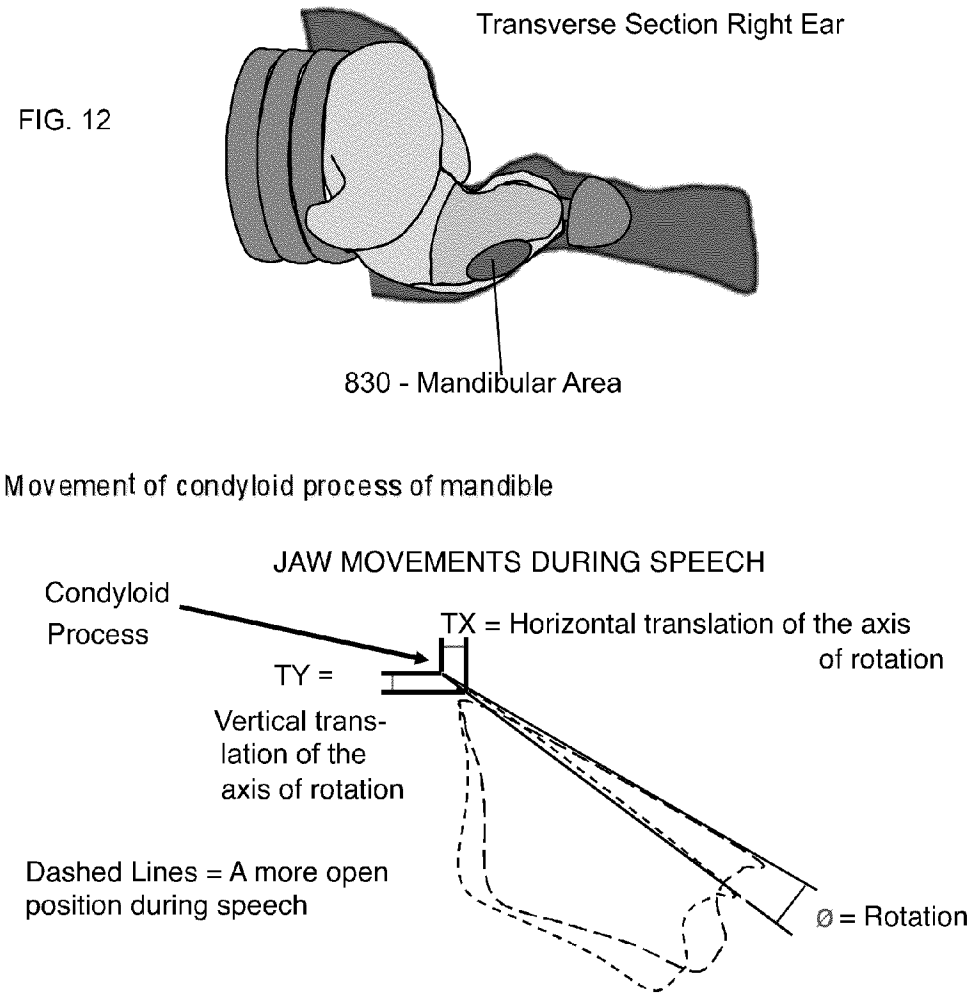
FIG. 12 illustrates at least one exemplary embodiment where the movement of the mandible is addressed via a specially located sealing element.

FIG. 12 illustrates at least one exemplary embodiment where the movement of the mandible in area 830 is addressed via a specially located sealing element. A soft, flexible/expandable section of an earpiece is used to manage mandibular movement during speech and eating. This area 830 compresses from the front back and then returns to its pre-compressed location. Horizontal, and not vertical displacement is a primary target. This section compresses very easily, with the section filled with air, or some other displacement material that moves easily, but returns to fill the canal when it is uncompressed.

Figure 13:
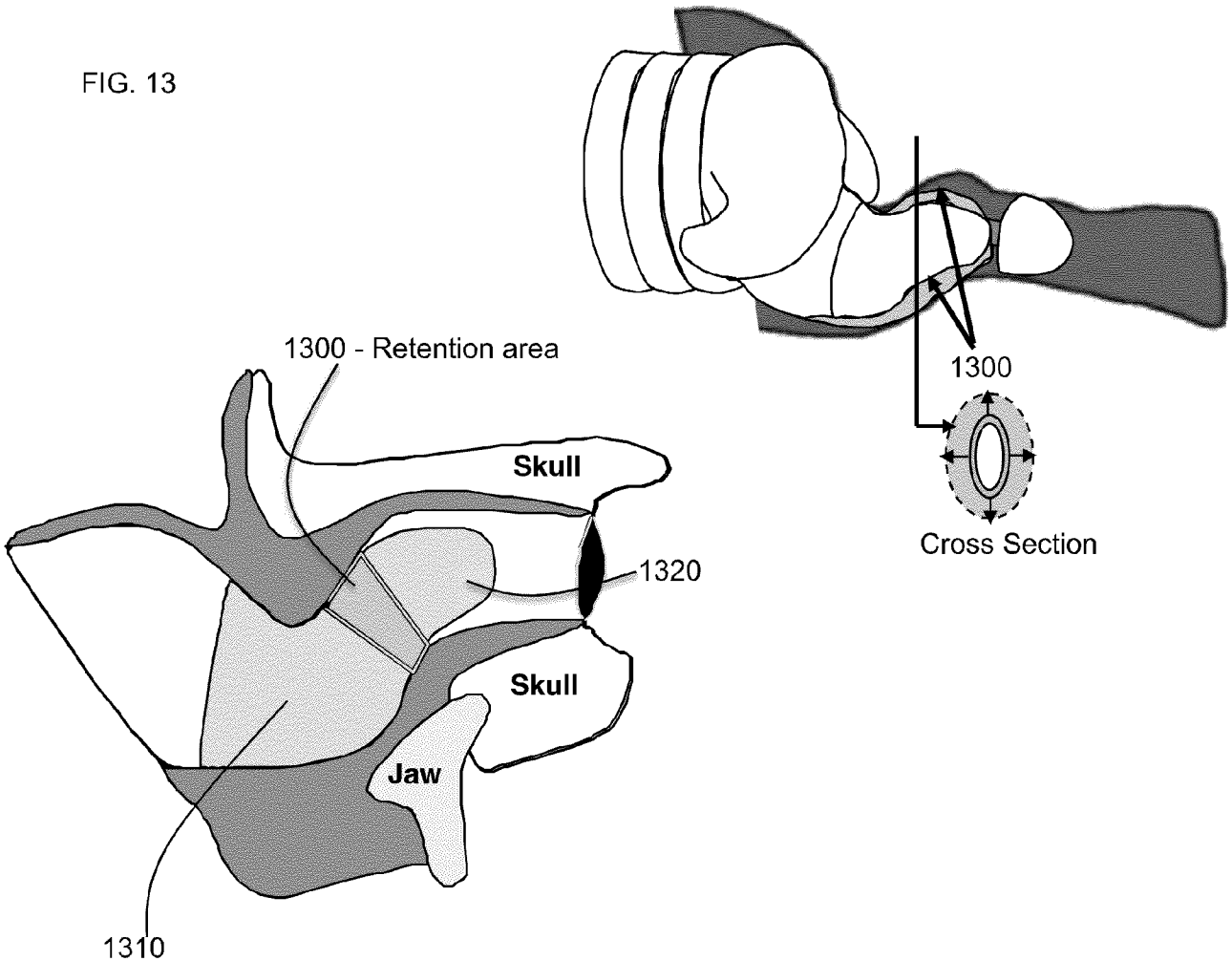
FIG. 13 illustrates a transverse view of various sealing sections of an earpiece device in accordance with at least one exemplary embodiment.

FIG. 13 illustrates a transverse view of various sealing sections of an earpiece device in accordance with at least one exemplary embodiment. For example retention area 1300 is made of an expandable material to the sides of the ear canal in all directions to support retention and also to facilitate insertion. It can be activated by light, temperature, pressure, humidity, or perspiration. It is compressible with comfort to manage mandibular movement during talking, mastication, or during any other activity that causes the mandible to move into this area. It is between sections 1310 and 1320 (the first turn 320 and second turn 330 of the ear canal 230).

Figure 14:
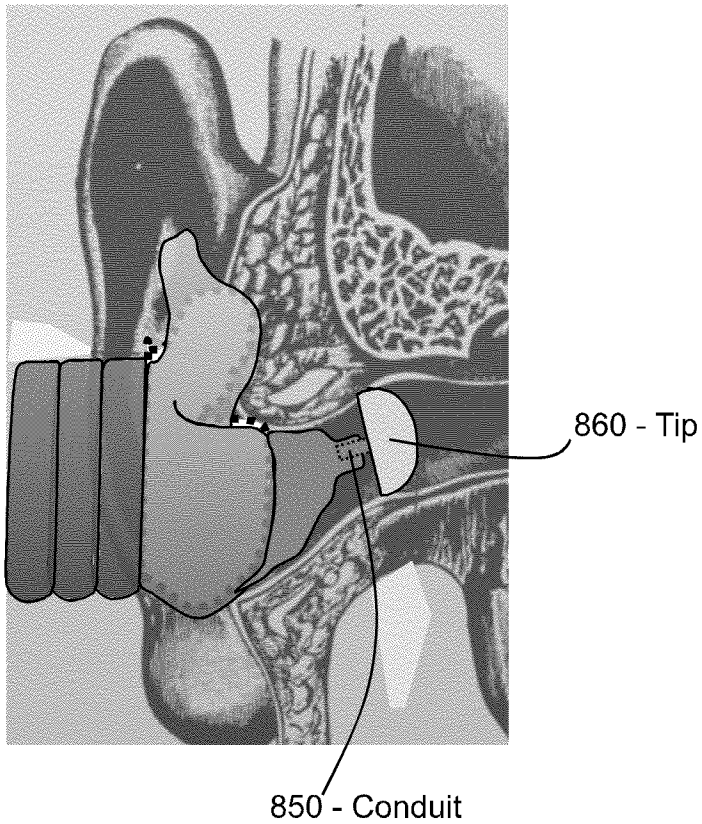
FIG. 14 illustrates a conduit for electronics attached to a flexible tip in accordance with at least one exemplary embodiment.

FIG. 14 illustrates a conduit 850 for electronics attached to a flexible tip 860 in accordance to at least one exemplary embodiment. The conduit 850 houses microphones and/or speakers, probes for these transducers, a channel to carry sound from the processor through the tip 860, or to serve as a transmission link for other communications between the electronics 810 and delivery into the ear canal 230. It can be of any construction material, size, and shape to manage these functions.

Figure 15:
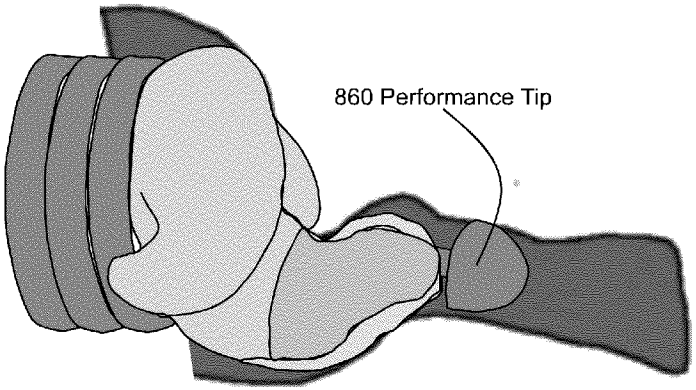
FIG. 15 illustrates a flexible performance tip in accordance with at least one exemplary embodiment, where in at least one variation the flexible tip helps to clean the ear canal when removed.

FIG. 15 illustrates a flexible performance tip 860 in accordance with at least one exemplary embodiment, where in at least one variation the flexible tip 860 helps to clean the ear canal when removed. Performance tip 860 is a soft material of silicone, rubber, foam or other moldable construction that either compresses during insertion and/or expands once inserted into the ear canal 230 to provide a comfortable seal of 15 to 30 dB attenuation to the ear canal from the external environment. It makes this contact and seal between the first bend 320 and second bend 330 of the ear canal or beyond the second bend 330 of the ear canal 230. Expansion can occur from heat, moisture, natural expansion from a compressed state, light, or other stimulant. It is affixed to the conduit 850 by any means available to provide for a firm connection. It can be replaceable to accommodate different size ear canals and for service.

Figure 16:
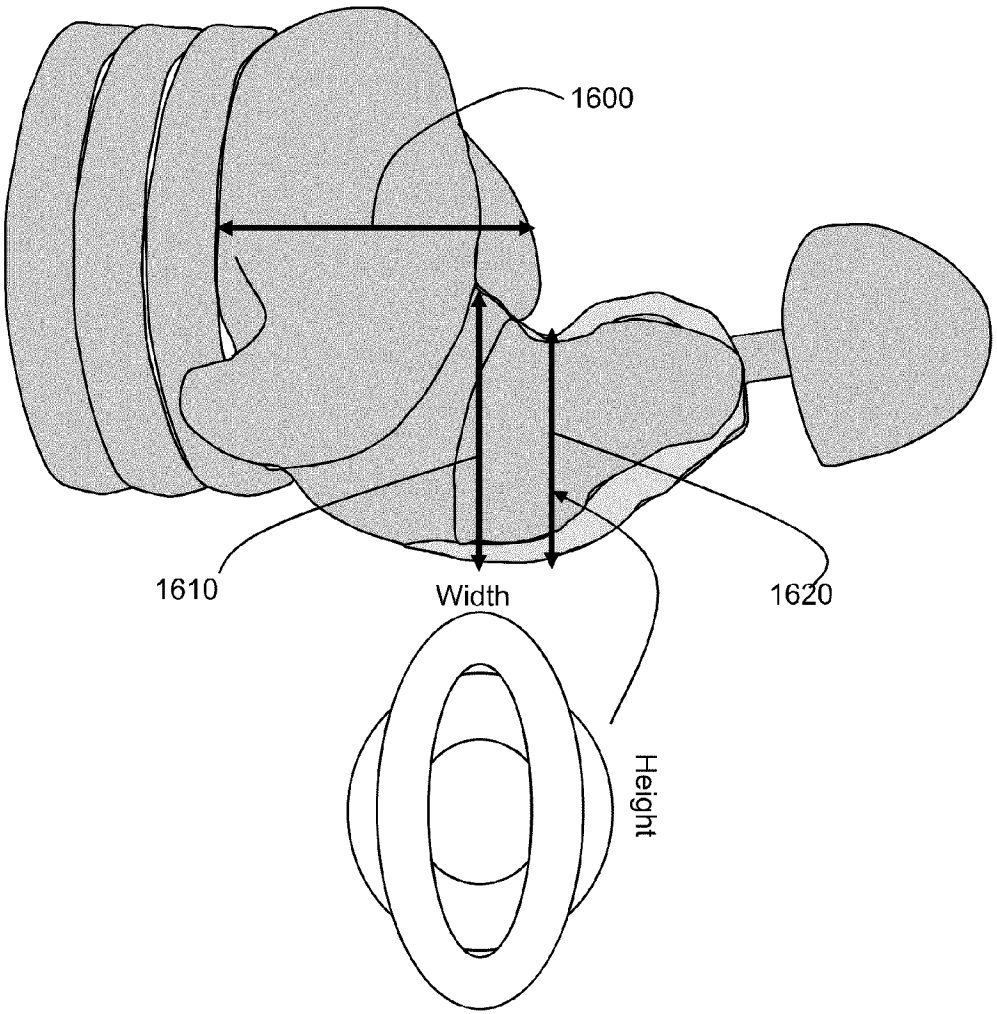
FIG. 16 illustrates the device of FIG. 13 with non-limiting examples of dimensional ranges.

FIG. 16 illustrates the device of FIG. 13 with non-limiting examples of dimensional ranges 1600, 1610, 1620.

Figure 17:
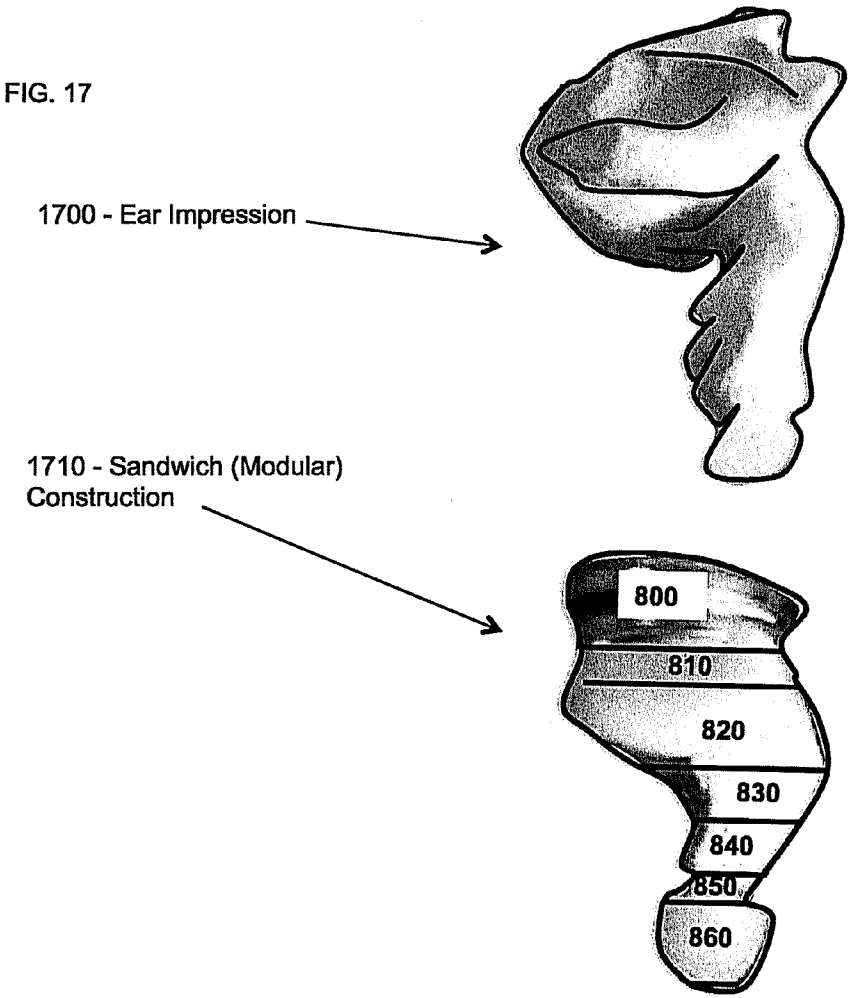
FIG. 17 illustrates a pictorial view of an earpiece in accordance with at least one exemplary embodiment compared to an ear impression, where sections are marked in accordance with various property sections as discussed herein.

FIG. 17 illustrates a pictorial view of an earpiece 1710 in accordance with at least one exemplary embodiment compared to an ear impression 1700, where sections are marked in accordance with various property sections as discussed herein.

Figure 18:
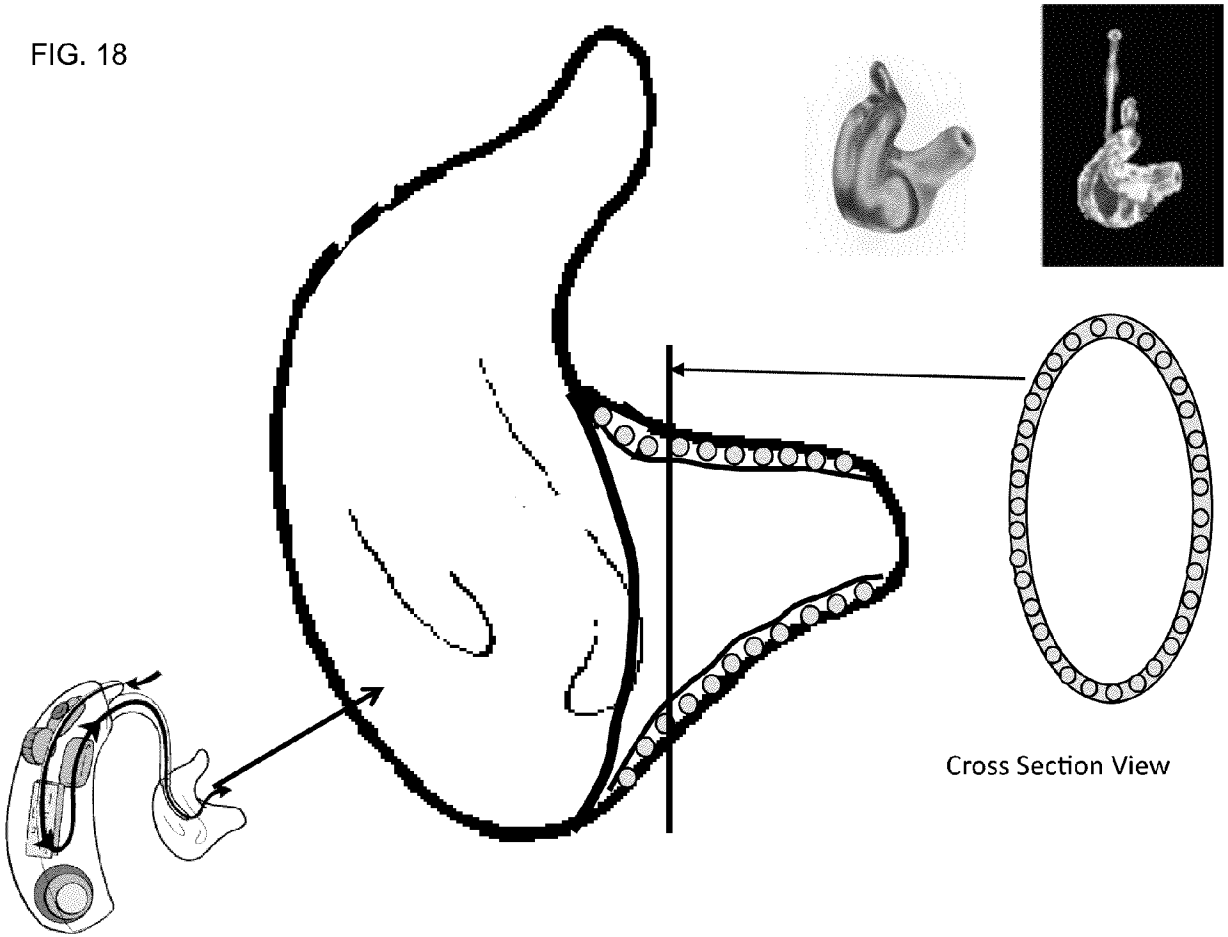
FIG. 18 illustrates a behind the ear configuration earpiece using a membrane cushion in accordance with at least one exemplary embodiment.

FIG. 18 illustrates a behind the ear configuration earpiece using a membrane cushion in accordance with at least one exemplary embodiment.

Figure 19:
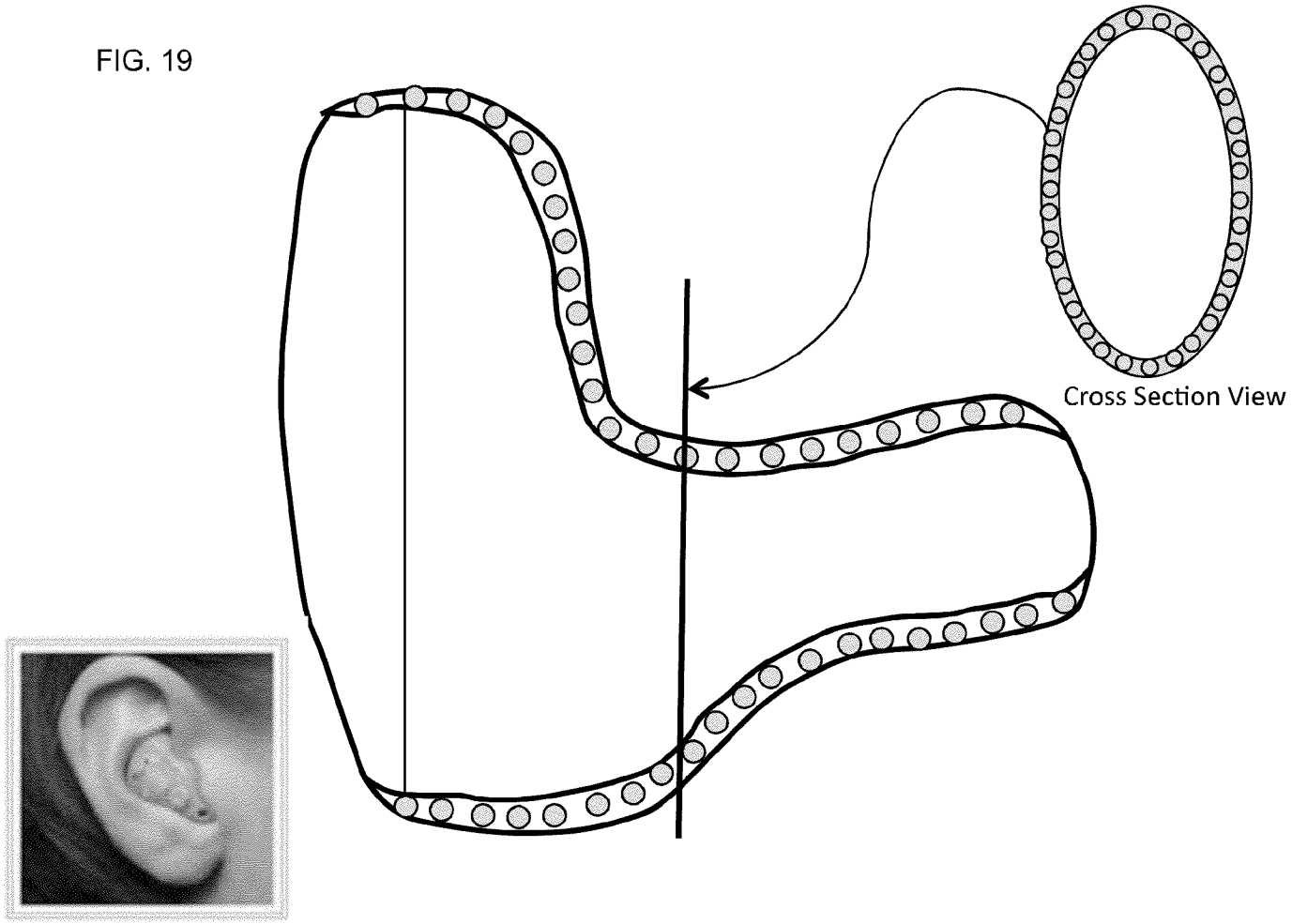
FIG. 19 illustrates an in-the-ear earpiece using a membrane cushion in accordance with at least one exemplary embodiment.

FIG. 19 illustrates an in-the-ear earpiece using a membrane cushion in accordance with at least one exemplary embodiment.

Figure 20:
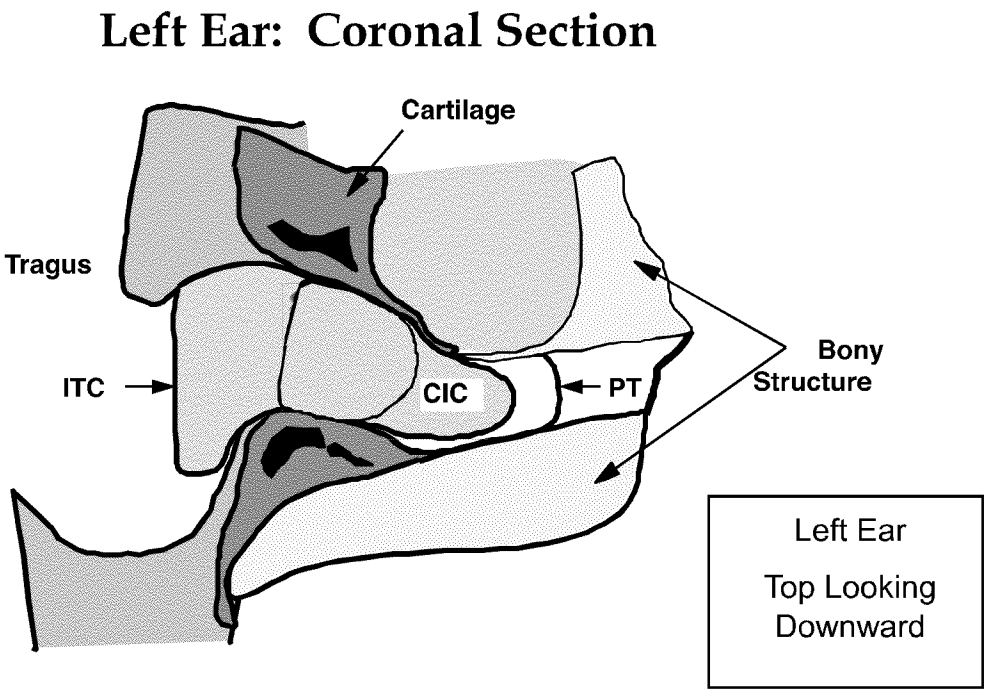
FIG. 20 illustrates the various types of earpieces (e.g., hearing aids) that can use a membrane cushion in accordance with at least one exemplary embodiment.

FIG. 20 illustrates the various types of earpieces (e.g., hearing aids) that can use a membrane cushion in accordance with at least one exemplary embodiment.

Figure 21:
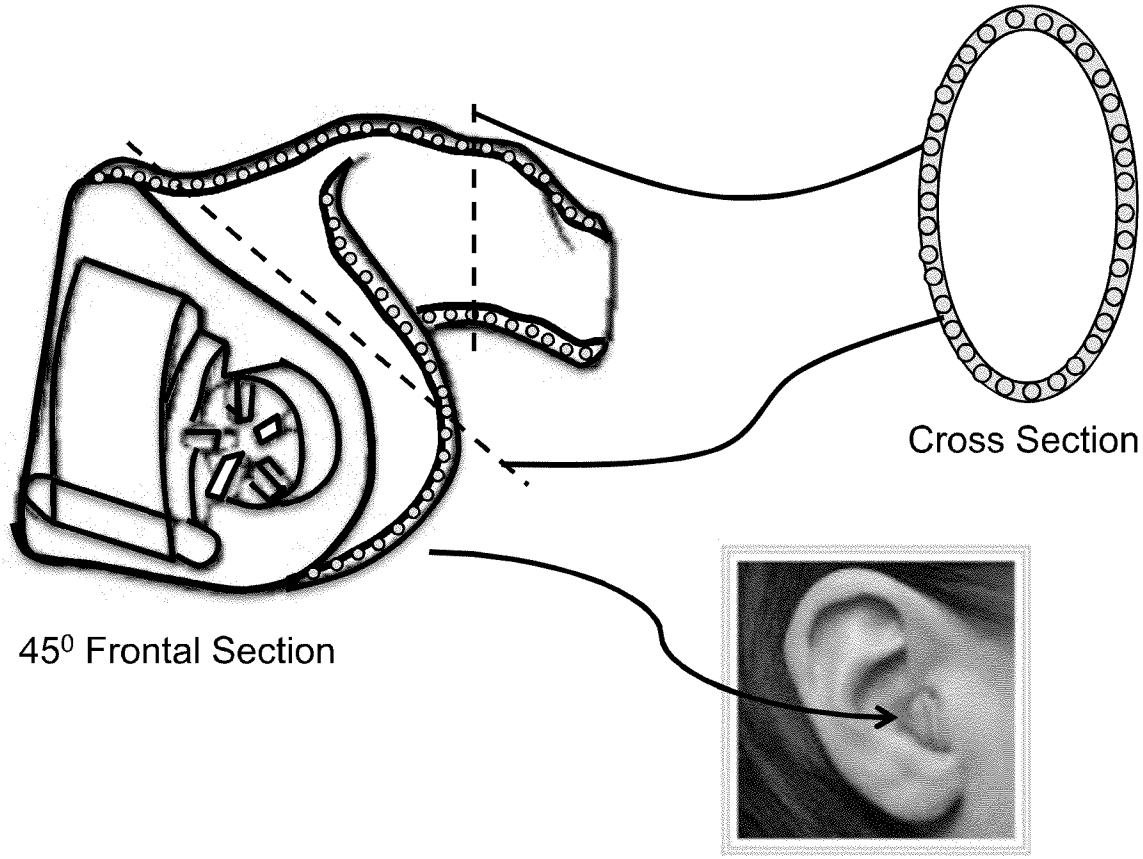
FIG. 21 illustrates another exemplary embodiment of an in the ear hearing aid.

FIG. 21 illustrates another exemplary embodiment of an in the ear hearing aid.

Figure 22:
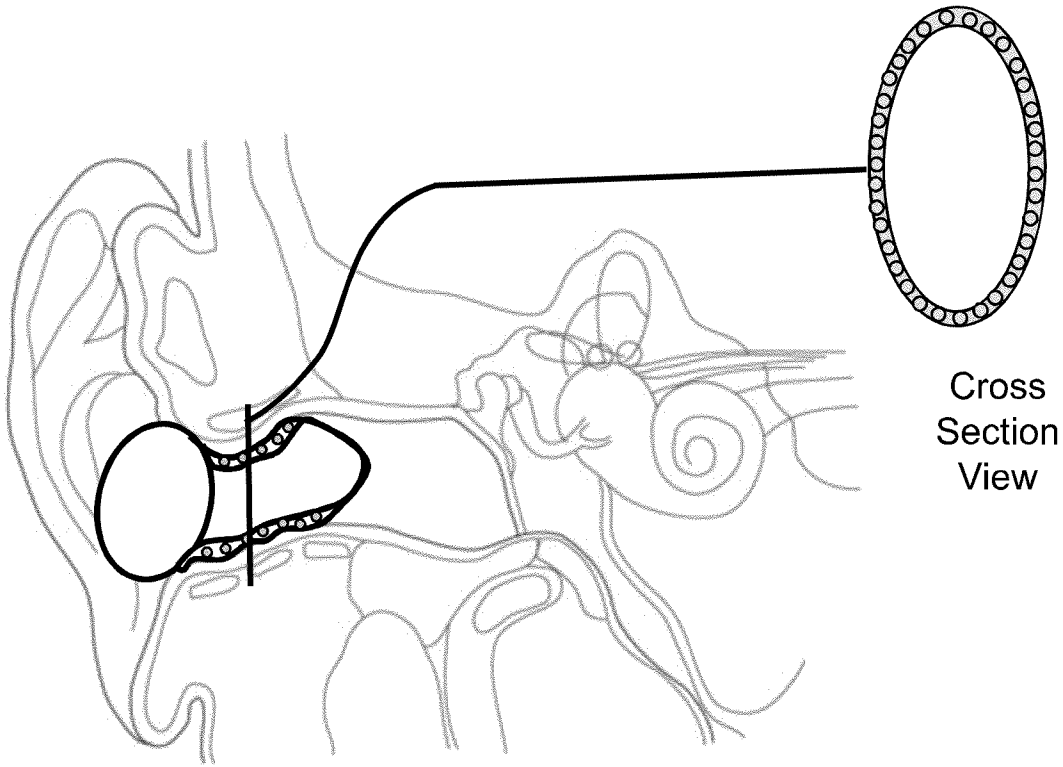
FIG. 22 illustrates an in-the-canal earpiece (e.g., hearing aid) using a membrane cushion in accordance with at least one exemplary embodiment.

FIG. 22 illustrates an in-the-canal earpiece (e.g., hearing aid) using a membrane cushion in accordance with at least one exemplary embodiment.

Figure 23:
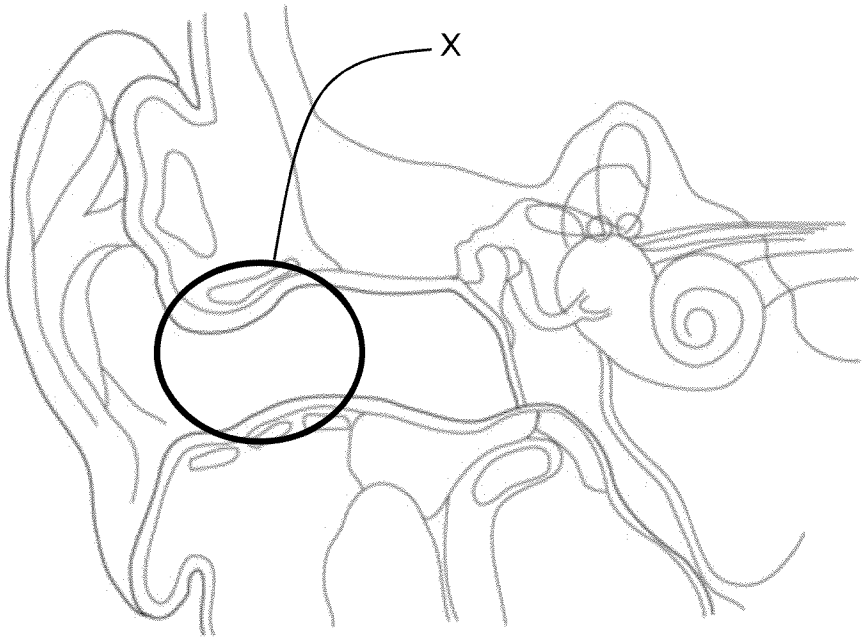
FIG. 23 illustrates at least one exemplary embodiment illustrating a region of comfort.

FIG. 23 illustrates at least one exemplary embodiment illustrating a region of comfort(X). In this area an expanded device construction is considered without creating significant discomfort because it is in the cartilaginous portion of the ear canal. This expanded area tapers off before approximating the bony ear canal wall. In many individuals, the cartilaginous portion is only ⅓ of the ear canal, rather than ½ as shown here.

Figure 24:
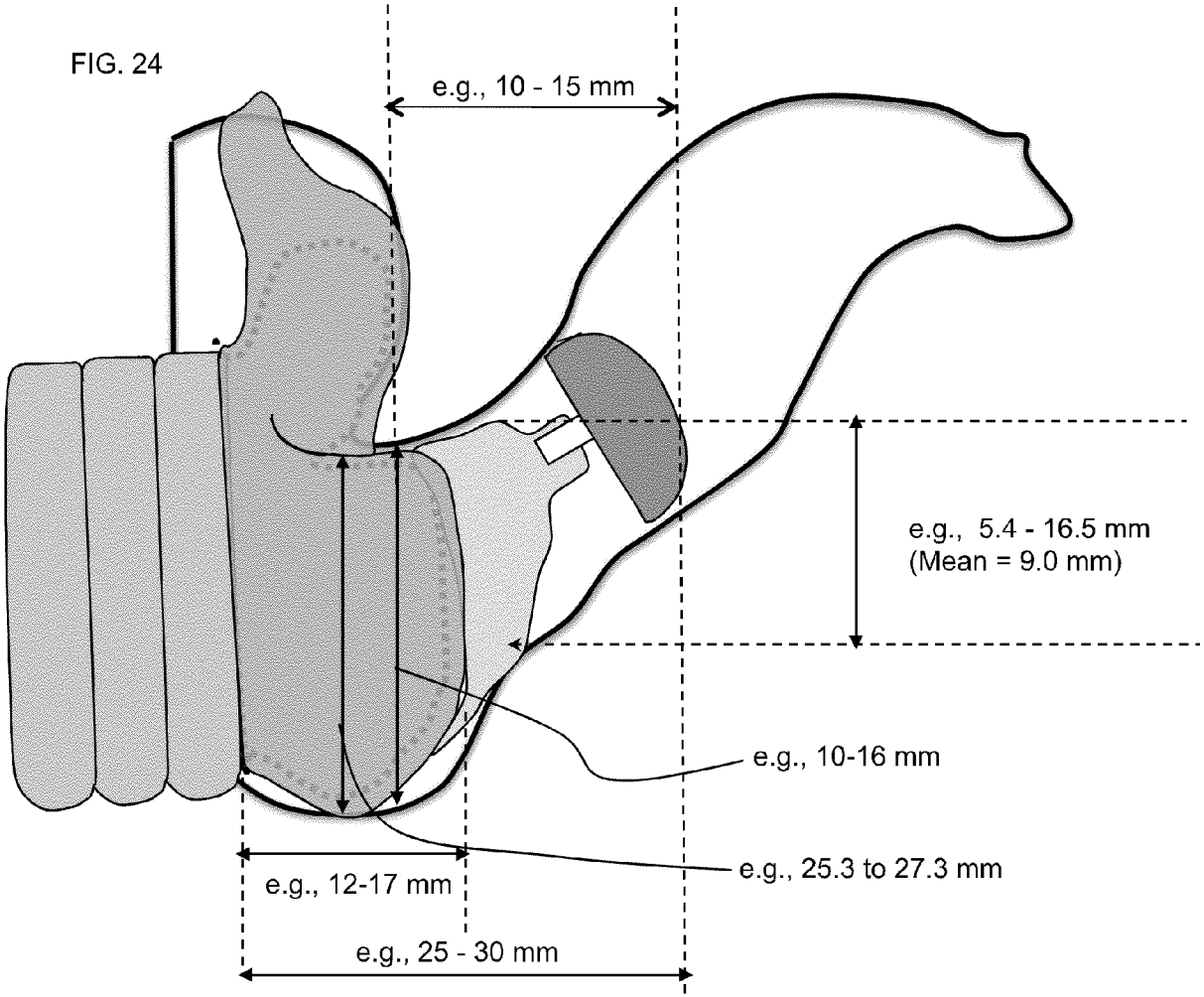
FIG. 24 illustrates various dimensional ranges for an earpiece in accordance with at least one exemplary embodiment.

FIG. 24 illustrates various non-limiting dimensional ranges for an earpiece in accordance with at least one exemplary embodiment.

Figure 25:
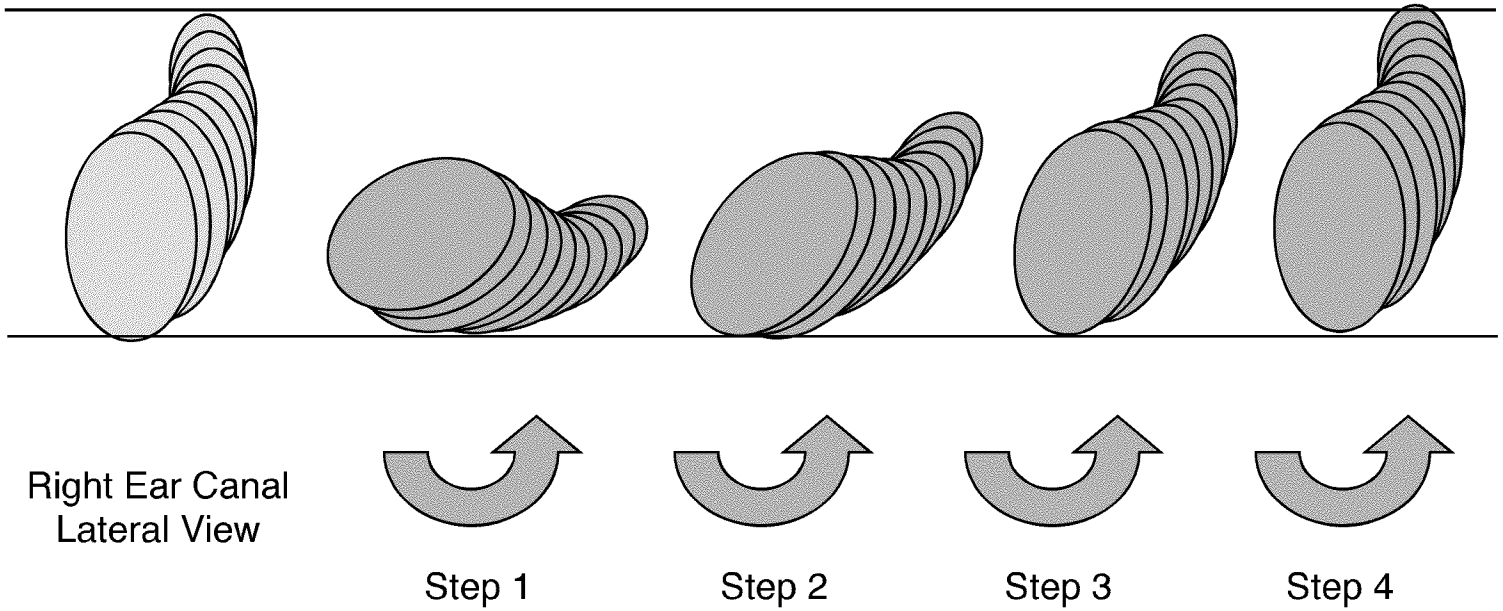
FIG. 25 illustrates an earpiece having a corkscrew configuration in accordance with at least one exemplary embodiment.

FIG. 25 illustrates an earpiece having a corkscrew configuration in accordance with at least one exemplary embodiment. Step 1 through 4 illustrate the insertion of an earpiece into the ear canal where the shape of the earpiece moves it upward into the canal rotating the earpiece (e.g., counterclockwise). Note that optionally an insertion handle can aid insertion.

Figure 26:
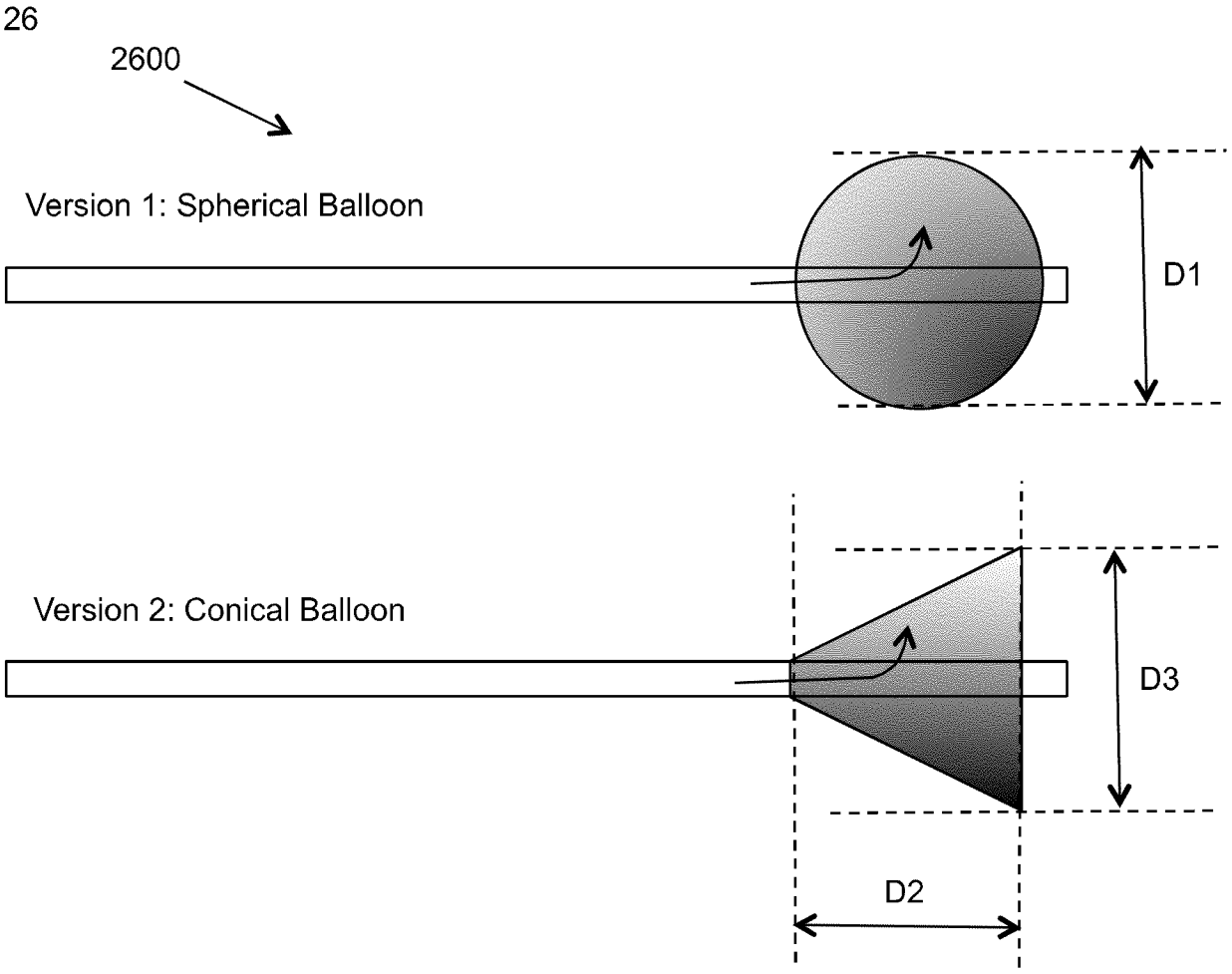
FIG. 26 illustrates various inflatable systems that can be used for expandable sections in accordance with at least one exemplary embodiment.

FIG. 26 illustrates various inflatable systems (2600) that can be used for expandable sections in accordance with at least one exemplary embodiment. The inflatable system 2600 can be a balloon, for example be of a low durometer (e.g., <50 shore) and can be of various diameters (e.g., D1 and D3, for example 12 mm), and of various lengths D2 (e.g., 12 mm). The balloons can be of various shapes (e.g., spherical and conical), and can be attached to a stent, which can carry an inflation medium that is inserted into the balloons via holes in the stent.

Figure 27:
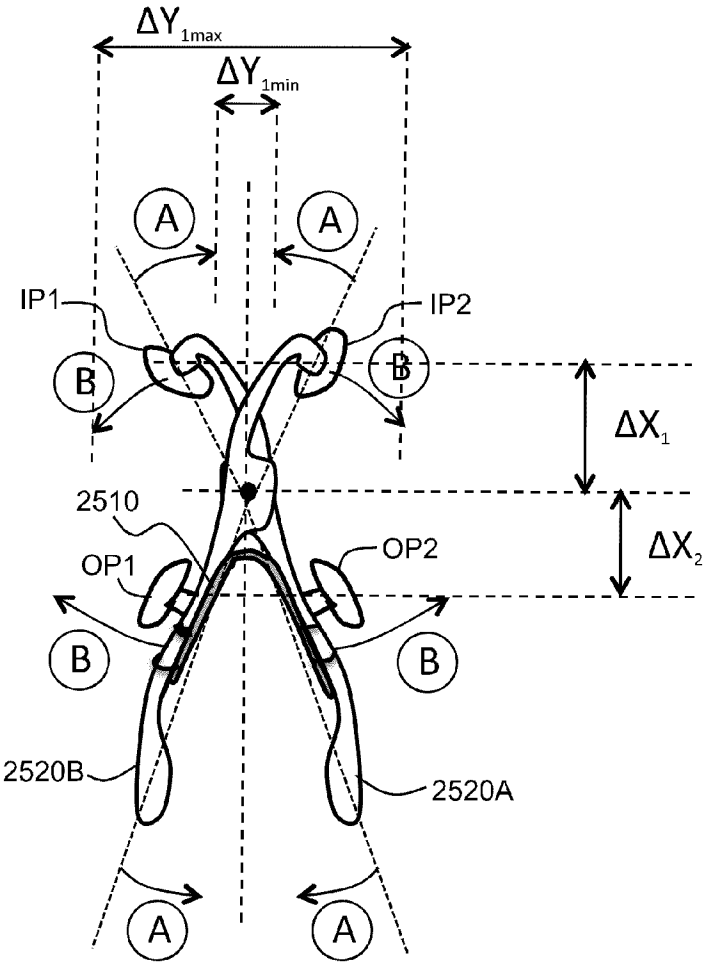
FIG. 27 illustrates an earclip configuration in accordance with the support system of at least one exemplary embodiment.

FIGS. 27-29 illustrate an "earclip" earpiece support structure. The earclip structure 2500 can be encased in a moldable material or layers of material with hand manipulators 2520A, 2520B sticking out of the earpiece. A user can press (A) the manipulators 2520A, 2520B which compress the outer pads OP1 and OP2, and the inner pads IP1 and IP2. Keeping the manipulators 2520A, 2520B pressed the user can insert the earclip into the ear canal, and release the manipulators (B). The outer pads OP1 and OP2 press on the narrowing portion of the ear canal, while the inner pads IP1 and IP2 press on the re-expanding portion of the ear canal after the narrowest region, keeping the earclip in place. The pressure with which the inner and outer pads press against the ear canal depend on the resilience of the resilient element 2510, which can be a hard plastic strip or metallic strip, that has memory retention and has been bent and attached to the arms 2520A and 2520B of the earclip. The pressure can be as low as 0.01 milligrams/mm^2. The inner and outer pads are illustrated as round cushions (stem base with moldable material attached), however they can also be curved, hemispherical, or any other shape, and additionally there can be more than two IPs and OPs. For example the radial pressure exerted by the inner and outer pads, or for that matter expandable systems in general can be a percentage above the seal pressure.

For example if the seal pressure is 1.1 gauge or 10% above atmospheric, then one can design the expandable system to exert a varying pressure for example 1.1 gauge+DP, where DP is a pressure above the seal pressure value, for example another 10% above atmospheric. Note that the seal pressure is defined as the pressure at which there is an acoustic isolation (the total Sound Pressure Level difference between two sides of a sealing element) greater than 3 dB. Note other values can be chosen, for example one can define the SPL difference between the two sides to be 5 dB at which that pressure is defined as the seal pressure.

In at least one exemplary embodiment the earclip has associated with it a long axis generally aligned with the ear canal long axis, and a transverse axis. The extent of the earclip in the transverse direction, $\Delta Y_{min}$, when the earclip has been compressed can be designed to fit pass the Isthmus (e.g., <5.5 mm), where when extended the max extension, $\Delta Y_{max}$, can be slightly larger than the mean size of an ear canal on either side of the Isthmus (e.g., 10 mm).

FIGS. 28A, 28B and 28C illustrate the earclip device of FIG. 27, in the ear canal in a front view and a top view. Note that the arms of the earclip can be designed to navigate the irregular shape of the ear canal. Additionally illustrated is the earclip 2800 encased in a moldable material, with other electronic elements (e.g., transducers, logic circuits such as logic circuit LC, power sources, microphones such as microphone AM, light sources, speakers) also embedded within the moldable material, the entirety of the system forming an earpiece. When the manipulators are compressed the moldable material responds and compresses, and when released the expandable material expands to seal the ear canal. Note that although the earclip in the figure is encased in one moldable material, exemplary embodiments are not limited to one material and the earclip can have varying material along the long and/or transverse axis of the ear canal. The pads (OP1, OP2, IP1, and IP2) can contact at relative points in the ear canal (e.g., P1, P2, P3, and P4). When the arms HP1 and HP2 are pressed the inner pads (IP1 and IP2) move toward the axis, the smallest profile should be designed to fit in most channels (e.g., ear canals), for example about 5 mm. When released the inner pads move away from the axis until contact with the channel wall provides enough pressure to halt their motion (e.g., balancing out a restoring force caused by the resilient member RM), for example a wire strip spring, hard plastic strip spring). If the ear clip is surrounded by a moldable (deformable) material (MM) then the material will compress and expand as the inner and outer pads move.

FIGS. 29A, 29B and 29C illustrate at least one exemplary embodiment of an earpiece, that can have a sealing element that has various sealing sections of varying materials. For example various hoops (e.g., 3310, 3320) of various cross-sections can be designed to contact particular regions of the ear canal wall (e.g., sections 1 and 2). The hoops can be varying in size, and softness, and expandability, then positioned on a rigid or semi-rigid instrument support column (e.g., stent 3300), which can be of irregular shape. The hoops can be attached adhesively, as previously discussed, then coated with a membrane to maintain a position when pressed upon in the long axis direction (e.g., inserting the earpiece). Additional sealing sections, such as section 3340 may be disposed on the earpiece. The various sections can produce retention forces and seating forces on the ear canal wall.

The distance from the IPs to the OPs is dependent upon where the pressure is designed to be applied. For example the rotation connection between the two arms of the earclip can be designed to be at the Isthmus (FIG. 16), where IPs and OPs contact with the ear canal wall on either side of the Isthmus, so that the IPs do not contact the region of the ear canal where bone is near the surface (e.g., section 830, 840, of FIG. 7).

Additionally if expandable systems are used then for various sections, then any expandable system in the cartilaginous region can be expanded to an occlusion effect pressure value. For example if an inflatable firming element is designed to surround an earpiece, the inflatable firming element can be pressurized to the sealing pressure value, firming up the cartilaginous region, and thus decreasing the amount of vocal sound entering the sealed region between the expandable system and the ear drum, thus decreasing the occlusion effect. Note that a single expandable section can be used to mitigate the occlusion effect (e.g., reduce the occlusion effect to below 5 dB) by firming up the cartilaginous region. Note that expandable systems can include electroactive polymers and gels, balloons, temperature reactive polymers, and mechanically expanding systems.

Note that the occlusion effect occurs when the ear canal is sealed and a person talks, it is an amplification in the sealed chamber of the person's voice leaking into the chamber. Shallowly inserted system (e.g., <⅔ the ear canal length) can suffer more of an occlusion effect than deeply inserted systems.

Note that various materials can be used for expandable systems, for example if balloons are used then nylon, or any other type of non-leaking material (e.g., does not leak more than 10% of the volume in the balloon in a 12 hour period). A non-limiting example of materials that can be used includes, electroactive gels and polymers, polymers that change their viscosity as a function of energy changes (e.g., temperature, stresses, pressure), gas (e.g., nitrogen, air, hydrogen, oxygen, water vapor), fluids (gas or liquids), liquids (e.g., water, salt water, water with impurities (e.g., HCL added)), Lucite, Hard acrylic, Ultra-Violet Resin, UV cure—hard plastic, Semi-hard waxy material, Soft Acrylic, Semi-soft plastic, Soft Ultra-Violet, UV cure—soft rubber, Silicone, Medical grade soft and hypoallergenic, Polyvinyl Chloride, Soft thermoplastic, Vinyl or PVC.

At least one exemplary embodiment is directed to an earpiece device comprising: an inner microphone; an outer microphone; an inner speaker, wherein the inner microphone, the outer microphone, and the inner speaker are operatively connected via a support structure; and a sealant element, wherein the sealant element includes at least a first section and a second section, where the first section includes a first material, and the second section includes a second material, where the second material is of a lower durometer than the second material. Where the inner microphone is directed toward measuring the acoustic environment on a first side of the sealing element, while the outer microphone measures the acoustic environment on a second side of the sealing element. For example the ear canal acoustic environment can be measured by one of the microphones while the other microphone measures the ambient environment.

At least one exemplary embodiment includes a tip where when inserted deforms to ease insertion into a channel (e.g., ear canal), and while removed will lightly scrap the channel wall removing any build up of loose material (e.g., ear wax). For example the tip can be conically designed to exceed the general population's ear canal dimensions (e.g., 10 mm diameter).

At least one exemplary embodiment can be spiral in shape where when inserted a portion seals circumferentially providing a seal within the channel.

In at least one exemplary embodiment the first section interacts with a portion of the cartilaginous region and the second section interacts with a portion of the bony region. For example the first section can be separated by the second section by several millimeters designed so that the first section sits in the cartilaginous region and the second section sits in the bony region.

Note that the first and second material can be of various durometers. Note also that exemplary embodiments are not limited to any number of sections.

At least one exemplary embodiment can use an expandable section or system. Where expandable is defined as increasing in dimension or decreasing in dimension from a start dimension (e.g., expansion and contraction are intended when referring to expandable systems). For example an inflatable system can be used with a fluid inside. The fluid can include a liquid, gas and gel or a combination of both, for example aphrons.

At least one exemplary embodiment firms up the cartilaginous region by an expandable section pressing up against the cartilaginous region with at least the seal pressure, thus firming up the cartilaginous region and decreasing the sound source leakage into the seal chamber section (note the channel need not be an ear canal, leakage from outside a normal channel can also leak into a sealed channel and cause amplification at certain acoustic frequencies).

At least one exemplary embodiment varies the sound isolation (e.g., sound attenuation and reflect) from one side of a sealing element and another by using an expandable system that is at least a portion of a sealing element. The expandable system (e.g., balloon) can be varied in internal pressure to vary the sound isolation from one side to the other. For example in an inflatable air system a seal pressure of 1.05 gauge pressure can provide 10 dB of sound isolation while an increase to 1.1 gauge pressure can provide 15 dB. Thus the sound isolation can be tuned depending upon the need.

In at least one exemplary embodiment a central stent is used to feed fluid into the expandable section.

At least one exemplary embodiment is directed to a method of mitigating the occlusion effect in shallowly inserted sealing systems comprising: inserting an expandable section into an ear canal, where the expandable system is shallowly inserted; and expanding the expandable section to pressure greater than or equal to a sealing pressure, where the sealing pressure is defined as the pressure where there is at least a 5 dB drop in acoustic energy between a first side of the expandable section to a second side of the expandable section.

In at least one exemplary embodiment the insertion of a system (e.g., earpiece) can be shallow which can be to insertion within the first four fifths of the length of the ear canal. Note also that at least one exemplary embodiment can be inserted deeply, greater than a defined value (e.g., ⅔, ⅘, ⅚, of an ear canal length) and an expandable system added to mitigate occlusion effect.

At least one exemplary embodiment includes a method where the expandable section provides a sound isolation value greater than 5 dB from the first side to the second side. For example where the second side faces the ear drum and the first side faces the ambient environment.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. An earpiece device comprising:

an inner microphone;

an outer microphone;

an inner speaker, wherein the inner microphone, the outer microphone, and the inner speaker are operatively connected via a support structure; and a sealant element, wherein the sealant element includes at least an expandable first section and a second section, the expandable first section coupled to an element that actively fills the first section with a fluid, to expand the expandable first section, the first section including a first material, and the second section including a second material different from the first material, the first section and the second section being coupled via a conduit, the first section and the second section arranged to be at different depths of an ear canal when inserted into the ear canal, the second section extending farther into the ear canal than the first section, wherein the first section of the sealant element has a length such that the first section is configured to be inserted into a cartilaginous region of the ear canal, without extending into a bony region of the ear canal, such that at least the first section of the sealant element seals the cartilaginous region, the first material providing a different acoustic isolation than the second material, wherein the first section is configured to be expanded via the element from a first diameter to a second diameter greater than the first diameter to seal the ear canal, each of first section and the second section being configured to press against an ear canal wall of the ear canal such that the first section applies a first pressure at the second diameter and the second section applies a second pressure, the second pressure being less than the first pressure, and wherein the second section has a diameter that is greater than a diameter of the ear canal and is configured to be compressed upon insertion into the ear canal, to seal the ear canal.

2. The earpiece device according to claim 1, wherein the fluid includes at least one of a liquid and a gel.

3. The earpiece device according to claim 1, wherein the second section includes a probe tip having a flexible material, wherein when the probe tip is removed from the ear canal the probe tip removes a material from the ear canal.

4. The earpiece device according to claim 1, wherein the sealant element is spiral in shape, wherein when the earpiece device is inserted into the ear canal the earpiece device is corkscrewed in, and where the sealant element varies in at least one material property along a longitudinal axis of the earpiece device.

5. The earpiece device according to claim 1, wherein the second material has an equal or lower durometer than the first material.

6. A sealant element comprising:

an expandable first section including a first material, the expandable first section coupled to an element that actively fills the first section with a fluid, to expand the expandable first section; and a second section including a second material different from the first material, the first section and the second section being coupled via a conduit, the first section and the second section arranged to be at different depths of an ear canal when inserted into the ear canal, the second section extending farther into the ear canal than the first section, wherein the first section of the sealant element has a length such that the first section is configured to be inserted into a cartilaginous region of the ear canal, without extending into a bony region of the ear canal, such that at least the first section of the sealant element seals the cartilaginous region, the first material providing a different acoustic isolation than the second material, wherein the first section is configured to be expanded via the element from a first diameter to a second diameter greater than the first diameter to seal the ear canal, each of the first section and the second section being configured to press against an ear canal wall of the ear canal such that the first section applies a first pressure at the second diameter and the second section applies a second pressure, the second pressure being less than the first pressure, and wherein the second section has a diameter that is greater than a diameter of the ear canal and is configured to be compressed upon insertion into the ear canal, to seal the ear canal.

7. The sealant element according to claim 6, wherein the ear canal is irregularly shaped.

8. The sealant element according to claim 6, wherein the fluid is at least one of a liquid or a gas.

9. The sealant element according to claim 6, wherein the first section firms up the cartilaginous region, reducing an occlusion effect.

10. The sealant element according to claim 6, wherein the second material has an equal or lower durometer than the first material.

11. The sealant element according to claim 6, wherein the second section is detachably coupled to the conduit.

12. An inflatable sealant element comprising:

an inflatable first section coupled to an element that actively fills the first section with a fluid, to inflate the inflatable first section; and a second section, where the first section and the second section are coupled via a conduit, the first section and the second section arranged to be at different depths of an ear canal when inserted into the ear canal, the second section extending farther into the ear canal than the first section, wherein the first section of the inflatable sealant element has a length such that the first section is configured to be inserted into a cartilaginous region of the ear canal, without extending into a bony region of the ear canal, such that at least the first section seals the cartilaginous region, where the first section is configured to increase from a first diameter to a second diameter greater than the first diameter, responsive to being at least partially filled with the fluid via the element, to seal the ear canal, where the first section is designed to absorb acoustic energy when at least partially filled with the fluid, and wherein the second section has a diameter that is greater than a diameter of the ear canal and is configured to be compressed upon insertion into the ear canal, to seal the ear canal.

13. The sealant element according to claim 12, wherein the ear canal is irregularly shaped.

14. The sealant element according to claim 12, wherein the first section reduces the occlusion effect when inserted into the ear canal and is at least partially filled with the fluid.

15. The sealant element according to claim 14, wherein the fluid is at least one of a gas or a liquid.

16. The sealant element according to claim 15, wherein the first section is inflated to different pressure values to provide different sound isolation values.

17. The sealant element according to claim 12, wherein the first section is pressurized to a gauge pressure between 0.1 bar and 0.3 bar.

18. The sealant element according to claim 12, wherein the second section is detachably coupled to the conduit.

19. A method of mitigating an occlusion effect in a sealing system comprising:

inserting an expandable first section and a second section of the sealing system into an ear canal such that the expandable first section and the second section are at different depths of the ear canal when inserted into the ear canal, the second section extending farther into the ear canal than the expandable first section, the expandable first section and the second section being coupled via a conduit, where the expandable first section has a length such that the expandable first section is configured to be inserted into a cartilaginous region of the ear canal, without extending into a bony region of the ear canal, the second section having a diameter that is greater than a diameter of the ear canal;

compressing the second section of the sealing system upon insertion into the ear canal, to seal the ear canal; and actively filling the expandable first section with a fluid via an element coupled to the expandable first section, to expand the expandable first section from a first diameter to a second diameter greater than the first diameter—, the element configured to expand the expandable first section to a pressure greater than or equal to a sealing pressure such that at least the expandable first section seals the cartilaginous region, where, at the sealing pressure there is at least a 5 dB drop in acoustic energy between a first side of the expandable first section to a second side of the expandable first section.

20. The method according to claim 19, wherein the expandable first section provides a sound isolation value greater than 5 dB from the first side to the second side.

21. The method according to claim 20, wherein the sound isolation value is varied by varying the pressure of the expandable first section.

* * * * *